US010561957B2

(12) United States Patent
Choi

(10) Patent No.: US 10,561,957 B2
(45) Date of Patent: Feb. 18, 2020

(54) TRANSFORMING TOY HAVING LAUNCHER

(71) Applicant: CHOIROCK CONTENTS FACTORY CO., LTD., Seoul (KR)

(72) Inventor: Jong-Ill Choi, Seoul (KR)

(73) Assignee: CHOIROCK CONTENTS FACTORY CO., LTD., Seoul (KR)

( * ) Notice: Subject to any disclaimer, the term of this patent is extended or adjusted under 35 U.S.C. 154(b) by 0 days.

(21) Appl. No.: 15/774,790

(22) PCT Filed: May 23, 2016

(86) PCT No.: PCT/KR2016/005420
§ 371 (c)(1),
(2) Date: May 9, 2018

(87) PCT Pub. No.: WO2017/122880
PCT Pub. Date: Jul. 20, 2017

(65) Prior Publication Data

US 2018/0333651 A1 Nov. 22, 2018

(30) Foreign Application Priority Data

Jan. 13, 2016 (KR) ..... 10-2016-0003986

(51) Int. Cl.
*A63H 33/00* (2006.01)
*A63H 18/02* (2006.01)
(Continued)

(52) U.S. Cl.
CPC ..... *A63H 33/003* (2013.01); *A63H 17/02* (2013.01); *A63H 17/25* (2013.01); *A63H 17/26* (2013.01);
(Continued)

(58) Field of Classification Search
CPC ..... A63H 18/02; A63H 18/025; A63H 33/00; A63H 33/003
See application file for complete search history.

(56) References Cited

U.S. PATENT DOCUMENTS 3,209,491 A * 10/1965 Roeper ..... A63H 18/028 446/211
4,188,748 A 2/1980 Rich et al.
(Continued)

FOREIGN PATENT DOCUMENTS

JP 2004-154398 A 6/2004
JP 2012-11029 A 1/2012
(Continued)

OTHER PUBLICATIONS

CN201147642Y (Year: 2008).*
(Continued)

*Primary Examiner* — Eugene L Kim
*Assistant Examiner* — Alyssa M Hylinski
(74) *Attorney, Agent, or Firm* — NSIP Law

(57) ABSTRACT

The present invention relates to a transforming toy and, particularly, to a multi-step transforming toy, wherein the toy transforms in a first step in a process of preparing for a launch and transforms in a second step in a process of lunching a traveling object, and the traveling object, which has passed through the transforming toy, also transforms. Therefore, the toy can arouse a child's interest and launch a predetermined shaped object such as a missile, a fist, or a baby dinosaur.

15 Claims, 27 Drawing Sheets

(51) Int. Cl.

| | |
|---|---|
| ***A63H 17/25*** | (2006.01) |
| ***A63H 17/26*** | (2006.01) |
| ***A63H 17/02*** | (2006.01) |
| ***A63H 17/44*** | (2006.01) |

(52) U.S. Cl.
CPC ..... *A63H 17/44* (2013.01); *A63H 18/02* (2013.01); *A63H 18/025* (2013.01); *A63H 18/028* (2013.01)

(56) References Cited

U.S. PATENT DOCUMENTS

| | | | | |
|---|---|---|---|---|
| 4,382,347 | A * | 5/1983 | Murakami | A63H 17/045 446/433 |
| 4,867,723 | A * | 9/1989 | Asbach | A63H 17/02 446/4 |
| 6,520,829 | B1 * | 2/2003 | Temple | A63H 17/05 446/434 |
| 7,628,674 | B2 * | 12/2009 | Nuttall | A63H 18/026 446/444 |
| 8,747,180 | B2 * | 6/2014 | O'Connor | A63H 17/008 446/168 |
| 2002/0072294 | A1 * | 6/2002 | Hornsby | A63H 17/28 446/465 |
| 2006/0270318 | A1 * | 11/2006 | Campbell | A63H 17/02 446/431 |
| 2007/0197124 | A1 * | 8/2007 | Sato | A63H 33/003 446/129 |
| 2015/0093964 | A1 * | 4/2015 | Schmid | A63H 17/44 446/476 |

FOREIGN PATENT DOCUMENTS

| | | | |
|---|---|---|---|
| KR | 10-1327305 | B1 | 11/2013 |
| KR | 10-2015-0099152 | A | 8/2015 |
| KR | 10-2016-0078073 | A | 7/2016 |

OTHER PUBLICATIONS

International Search Report dated Oct. 4, 2016 in counterpart International Patent Application No. PCT/KR2016/005420 (2 pages in English and 2 pages in Korean).

* cited by examiner

TRANSFORMING TOY HAVING LAUNCHER

CROSS REFERENCE TO RELATED APPLICATIONS

This application is a U.S. National Stage Application of International Application No. PCT/KR2016/005420, filed on May 23, 2016, which claims the benefit under 35 USC 119(a) and 365(b) of Korean Patent Application No. 10-2016-0003986, filed on Jan. 13, 2016, in the Korean Intellectual Property Office.

BACKGROUND

1. Field

The following description relates to a transforming toy, and more particularly, to a multi-step transforming toy that transforms into a first form in a process where launch is ready and into a second form in a process where a traveling object is launched, so that the traveling object, which has passed through the transforming toy, also transforms, thereby causing a child's interest and also launching predetermined shaped objects, such as missiles, fists, or baby dinosaurs.

2. Description of Related Art

A transforming toy, which has a form of a car or robot, is configured to transform into another form. Such one transforming toy transforms into another form, and accordingly, children can enjoy a variety of plays through transforming forms of the transforming toys, while having a lot of funs.

In case of conventional transforming toys, their parts are generally folded, unfolded, assembled, or disassembled by children to allow the transforming toys to transform into other forms, so that it is inconvenient to play with them. While children who are not used to the transforming process of the transforming toys try to transform the transforming toys, further, the transforming toys may be broken.

Also, most of transforming toys have one transforming form, and not too long after, accordingly, children easily feel bored in playing with them.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the present invention to provide a transforming toy that automatically transforms in a process where a traveling object is launched, while not transform by means of a child's direct manipulation.

It is another object of the present invention to provide a transforming toy that transforms into various forms, not into one form.

It is still another object of the present invention to provide a transforming toy that is provided with a traveling object transforming into another form after passing therethrough.

It is yet another object of the present invention to provide a transforming toy that launches predetermined shaped objects, such as missiles, fists, dinosaurs, or cars therefrom when a traveling object passes therethrough.

To accomplish the above objects, there is provided a transforming toy including: a main body having a traveling object inlet formed on one side thereof and a traveling object outlet formed on the other side thereof; transforming bodies developably fastened to the main body; locking parts for restraining the development of the transforming bodies; a transformation operating part disposed on a path connecting the traveling object inlet and the traveling object outlet of the main body to each other in such a manner as to release the locking parts of the transforming bodies to develop the transforming bodies; and a traveling object driven along the path connecting the traveling object inlet and the traveling object outlet of the main body, wherein at the moment when the traveling object comes into contact with the transformation operation part while being driven in an interior of the main body, the transforming bodies are developed to allow the transforming toy to transform into another form.

In another general aspect, there is provided a transformation operating part includes: a pair of rods rotatably disposed on both sides of the path connecting the traveling object inlet and the traveling object outlet in the interior of the main body and having push rods protruding from one side thereof; an impact bar having both side end portions fastened to the pair of rods; handles rotatably disposed on the main body in such a manner as to come into contact with the push rods, and the locking parts rotate cooperatively with the handles and have locking bars for restraining the transforming bodies, so that the transformation operating part releases the locking states of the transforming bodies through the displacement of the locking bars.

In another general aspect, there is provided a path connecting the traveling object inlet and the traveling object outlet is formed by an inclined slope, or an inclined slope is disposed on one side of the path connecting the traveling object inlet and the traveling object outlet, so that the traveling object is driven along the slope by means of gravity.

In another general aspect, there is provided the main body has a slope cover hinge-fastened thereto, and if the slope cover is open, the slope cover comes into contact with the slope so that the slope is extended.

In another general aspect, there is provided the transforming toy further including a launch tray disposed on the traveling object inlet to apply a thrust force to the traveling object, so that the traveling object is driven to the interior of the main body.

In another general aspect, there is provided the launch tray being pushed by a user to apply the trust force to the traveling object seated thereon.

In another general aspect, there is provided the launch tray having a back panel disposed at the end portion thereof and firing pins disposed in the back panel in such a manner as to be elastically supported against springs and restrained by the locking parts, so that as the locking parts are released from the locking states thereof, the firing pins apply the trust force to the traveling object seated on the launch tray by means of elasticity of the springs.

In another general aspect, there is provided the transforming toy further including first transforming bodies developably fastened to the main body; locking parts for restraining the development of the first transforming bodies; and first transformation operating parts for releasing the locking parts of the first transforming bodies to develop the first transforming bodies, wherein the first transforming bodies are developed through manipulation of the first transformation operating parts to allow the transforming toy to transform into another form.

In another general aspect, there is provided the first transforming bodies being doors disposed on the traveling object outlet of the main body, and the doors are developed by the activation of the first transformation operating parts to open the traveling object outlet.

In another general aspect, there is provided the transforming toy further includes a launching part disposed on the main body to launch launching objects having given shapes through the displacement of the transformation operating part.

In another general aspect, there is provided the launching part including launching holes formed on the main body; firing pins disposed in the interiors of the launching holes in such a manner as to be elastically supported against springs; and a locking part for restraining the firing pins in such a manner as to release the locking states of the firing pins through the displacement of the transformation operating part or the transforming bodies.

In another general aspect, there is provided the transforming toy further including a transformation inducing item launching part disposed on the main body to launch a transformation inducing item through the displacement of the transformation operating part.

In another general aspect, there is provided the transformation inducing item launching part includes: an item launching hole formed on the main body; a firing pin disposed in the item launching hole in such a manner as to be elastically supported against a spring; and a locking part for restraining the firing pin in such a manner as to release the locking state of the firing pin through the displacement of the transformation operating part or the transforming bodies.

In another general aspect, there is provided at the moment when the traveling object comes into contact with the transformation inducing item launched, a locking part of the traveling object is released to allow the traveling object to transform into another form.

In another general aspect, there is provided the transformation inducing item has a magnetic material disposed in an interior thereof and the locking part of the traveling object has a magnet disposed on one side thereof, so that the magnet displaces the locking part of the traveling object through a magnetic force generated in response to the magnetic material of the transformation inducing item to release the locking state of the locking part of the traveling object.

In another general aspect, there is provided the locking part of the traveling object is displaced through a physical contact with the transformation inducing item and is released from the locking state.

In another general aspect, there is provided the main body having a plurality of loading boxes disposed thereon to store the launching objects, the traveling object, and the transformation inducing item.

In another general aspect, there is provided the transforming toy automatically transforms into other forms in a process where the traveling object is launched, while not transform by means of a child's direct manipulation, thereby obtaining his or her interest.

In another general aspect, there is provided the transforming toy that launches the predetermined shaped objects, such as missiles, fists, dinosaurs, or cars therefrom when the traveling object passes therethrough, and the traveling object launched therefrom transforms into another form, thereby enjoying play with lots of fun and being also applicable to various plays.

Other features and aspects will be apparent from the following detailed description, the drawings, and the claims.

Figure 1:
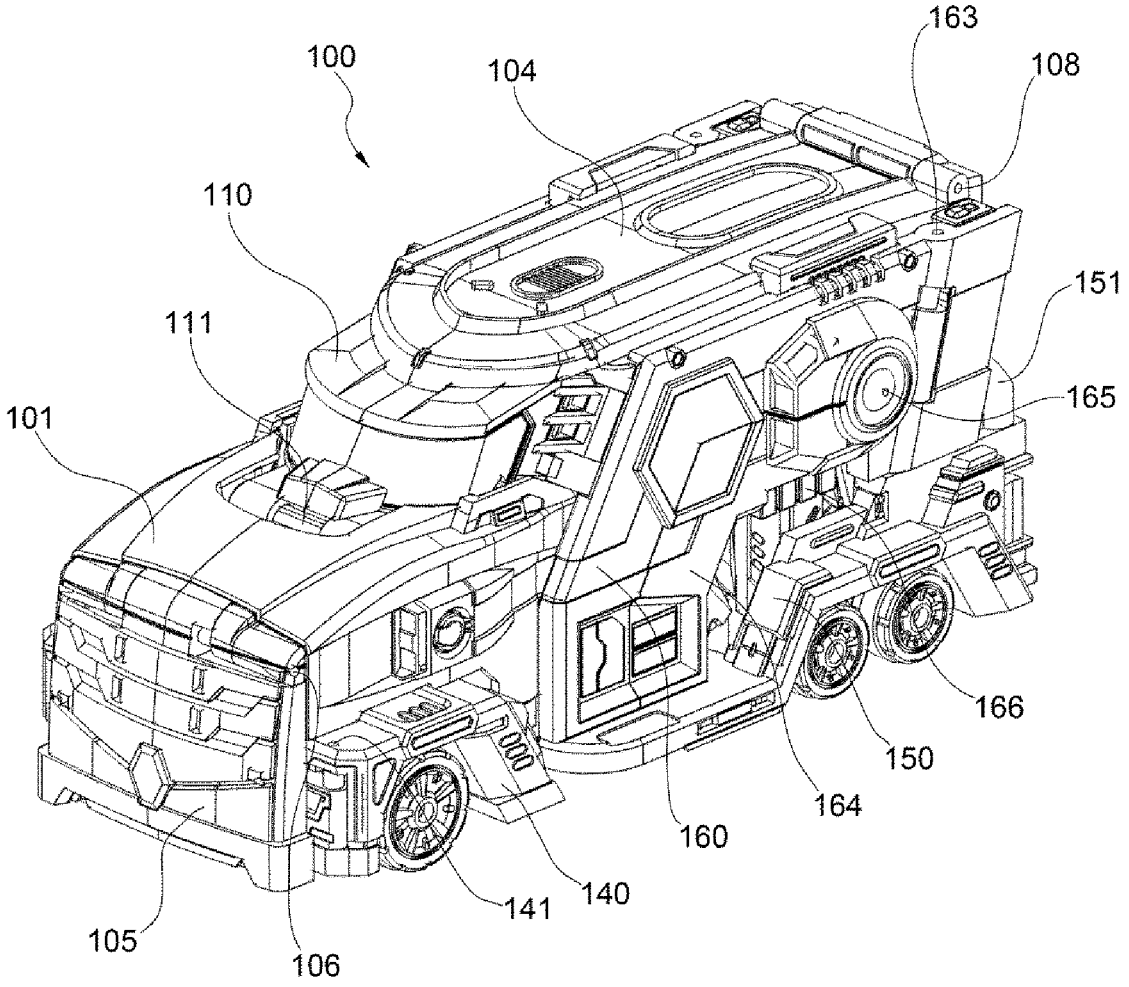
FIG. 1 is a perspective view showing a transforming toy according to a first embodiment.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

Hereinafter, an explanation on a transforming toy according to the present invention will be in detail given with reference to the attached drawing. In the description, it should be noted that the parts corresponding to those of the drawings are indicated by corresponding reference numerals.

In the description and the claims of the present invention, when it is said that one portion is described as "includes" any component, one element further may include other components unless no specific description is suggested.

First Embodiment

As shown in FIG. 1, a transforming toy according to a first embodiment of the present invention has a shape of a car before transforms. In FIG. 1, a bonnet portion of the first is called 'front side', and a rear portion thereof is called 'rear side'.

According to the first embodiment of the present invention, the transforming toy has different shapes before and after transforms, such as airplane, car, train, and ship as transportation means, robot, dinosaur, and given character.

A shaft on which a torsion spring is fitted to provide a rotary force is called 'torque shaft'.

Figure 3:
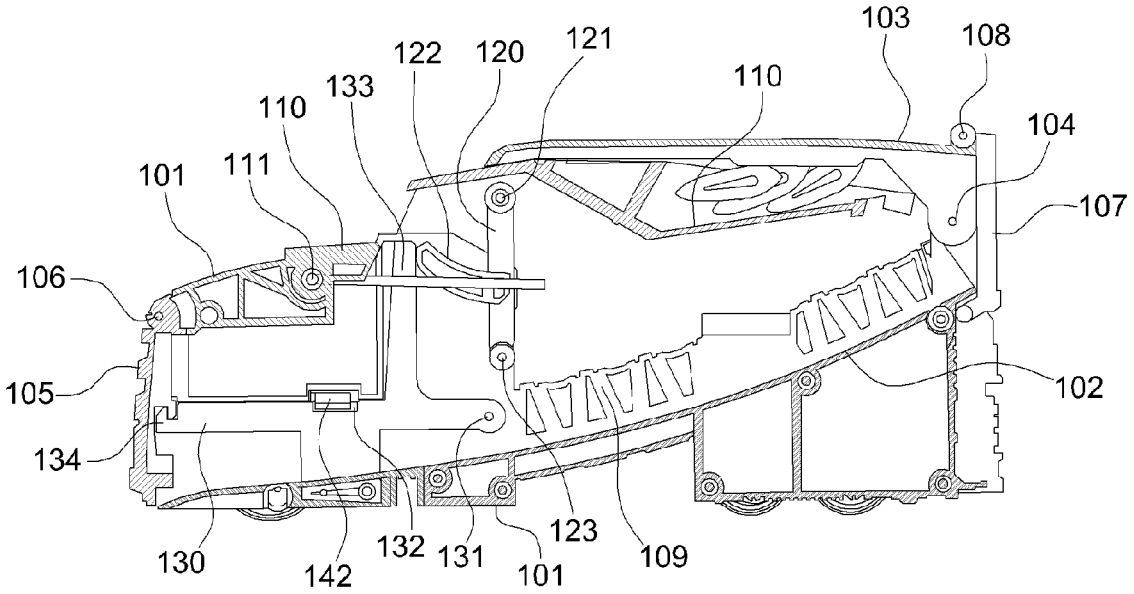
FIG. 3 is a sectional view showing an internal structure of the transforming toy according to the first embodiment.

As shown in FIG. 1, the transforming toy 100 before transforms, which has a shape of a car (even if the transforming toy 100 according to the first embodiment of the present invention has the shape of the car, but of course, it is not limited specially thereto), includes a main body 101 having a door 105 disposed on the front side thereof in such a manner as to be fastened to a shaft 106, a slope cover 103 disposed on top thereof in such a manner as to be fastened to the main body 101 by means of a shaft 104, as shown in FIG. 3, and a back cover 107 disposed on the rear side thereof in such a manner as to be fastened to the rear side of the slope cover 103 by means of a shaft 108.

Further, the transforming toy 100 has wings 160 foldedly disposed on both sides thereof in such a manner as to come close contact with the main body 101 and front legs 140 and rear legs 150 disposed above front and rear wheels thereof in such a manner as to come close contact with the main body 101.

Figure 2:
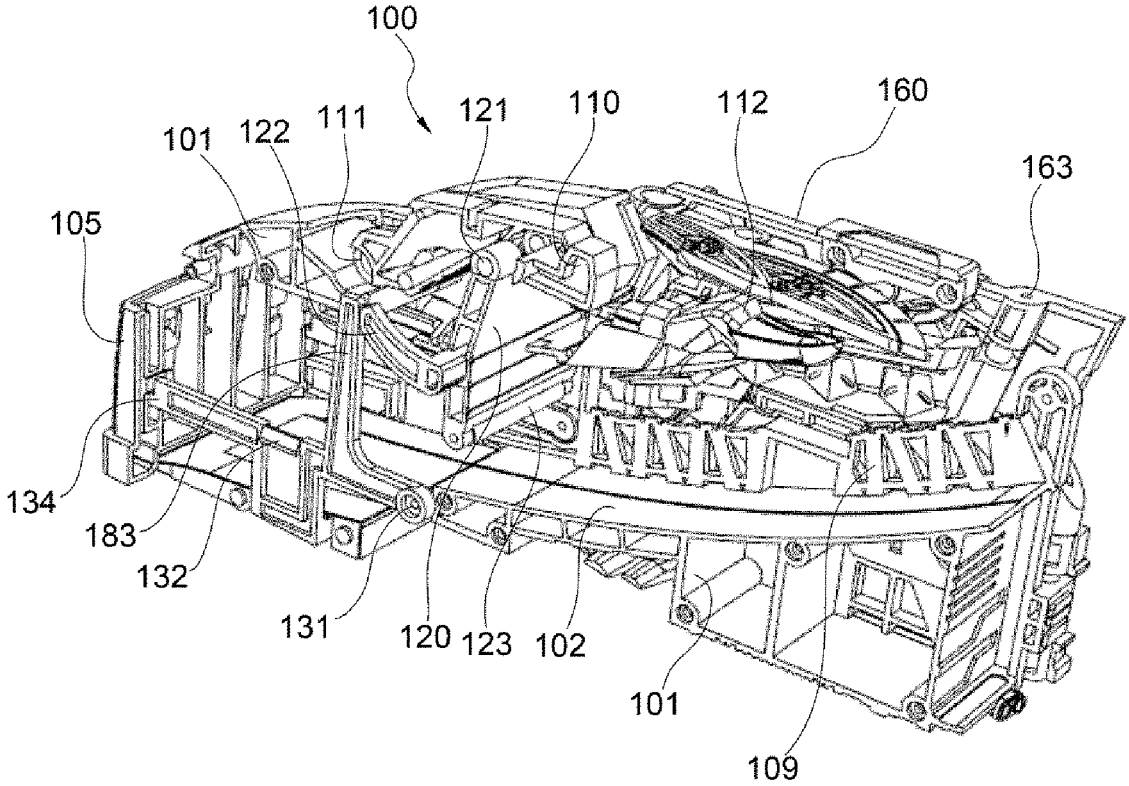
FIG. 2 is a perspective view showing a partial section of the transforming toy according to the first embodiment.

As shown in FIG. 2, the transforming toy 100 has a slope 102 disposed in the interior thereof in such a manner as to be inclined downwardly from the rear side thereof toward the front side thereof, and before the transforming toy 100 transforms, the slope 102 in the interior of the transforming toy 100 is not exposed by means of the slope cover 103 and the back cover 107.

According to the first embodiment of the present invention, as shown in FIGS. 2 and 3, before the transforming toy 100 transforms, a head frame 110 is fastened to top of the main body 101 by means of a head frame shaft 111 and hinge-fastened to top ends of rods 120 by means of a shaft 121.

According to the first embodiment of the present invention, the rods 120 are hinge-fastened to the head frame 110, but of course, they may be hinge-fastened to the main body 101.

The rods 120 are extended downwardly toward an intermediate portion of a path on the slope 101 and have push rods 122 extended forwardly from the center portion thereof in such a manner as to come into contact with handles 133 of locking bars 130.

The rods 120 and the locking bars 130 constitute a transformation operating part for transforming the transforming toy 100.

The shafts 106, 111 and 121 are torque shafts to which torsion springs are fitted. Also, shafts 131, 141, 151, 161, 163 and 165 as will be discussed later are torque shafts to which torsion springs are fitted.

On both sides of the interior of the transforming toy 100, as shown in FIG. 3, one side end portion of each locking bar 130 is hinge-fastened to the main body 101 by means of the shaft 131. Each locking bar 130 rotates in a clockwise direction around the shaft 131 by means of the torsion spring (not shown).

The other side end portion of each locking bar 130 is extended to the door 105 of the transforming toy 100, and each locking bar 130 has a lock-shaped door locking part 134 formed on the other side end portion thereof in such a manner as to be locked onto a locking groove formed inside the door 105 to prevent the door 105 from opening.

Through the torsion spring not shown in the figures, the door 105 rotates in the clockwise direction around the shaft 106 and is thus open, but through the restraint of the door locking part 134 of each locking bar 130, the door 105 is not open.

Front leg locking parts 132 disposed on the intermediate portions of the locking bars 130 are locked onto front leg locks 142 folded to both sides of the transforming toy 100 to prevent the front legs 140 from being unfolded, and the handles 133 protruding upwardly from the intermediate portions of the locking bars 130 come into contact with the push rods 122 of the rods 120.

As shown in FIG. 3, the rods 120 receive a rotary force in the clockwise direction around the shaft 121 from the torsion spring, and as the handles 133 of the locking bars 130 come into contact with the push rods 122 of the rods 120, a force for rotating the rods 120 around the shaft 121 and a force for rotating the handles 133 around the shaft 131 are balanced with each other, so that the state as shown in FIG. 3 is kept.

Figure 4:
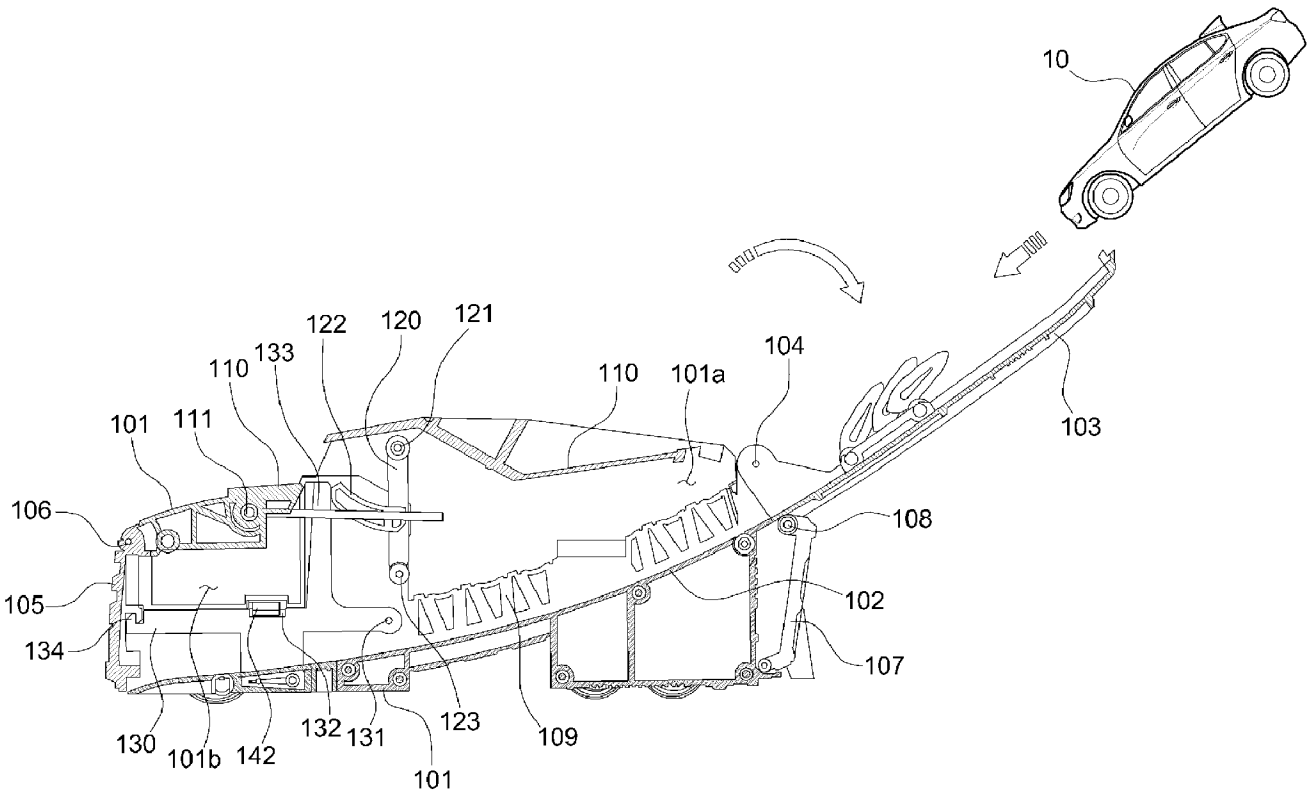
FIG. 4 is a sectional view showing a state where a slope cover of the transforming toy according to the first embodiment is open to launch a traveling object.

So as to allow the transforming toy 100 having the above-mentioned configuration to transform, as shown in FIG. 4, the slope cover 103 is open to allow the slope 102 disposed in the interior of the transforming toy 100 to be exposed to the outside. If the slope cover 103 is open, as shown in FIG. 4, the end of the slope cover 103 comes into contact with the end of the slope 102, so that the slope 102 is extended.

The slope 102 is a traveling path connecting a traveling object inlet 101*a* and a traveling object outlet 101*b* with each other, and if the slope cover 103 is open, the inner surface of the slope cover 103 is inclinedly connected to the slope 102, thereby extending the slope 102.

If a traveling object 10 is placed on the inclined slope 102, further, it is driven to the interior of the transforming toy 100 along the inclined slope 102. Slope guards 109 are located on both sides of the slope 102 to allow the traveling object 10 to be driven along the slope 102, without any trouble.

According to the first embodiment of the present invention, the traveling object 10 has a shape of a car, but of course, it may have different shapes.

Figure 5:
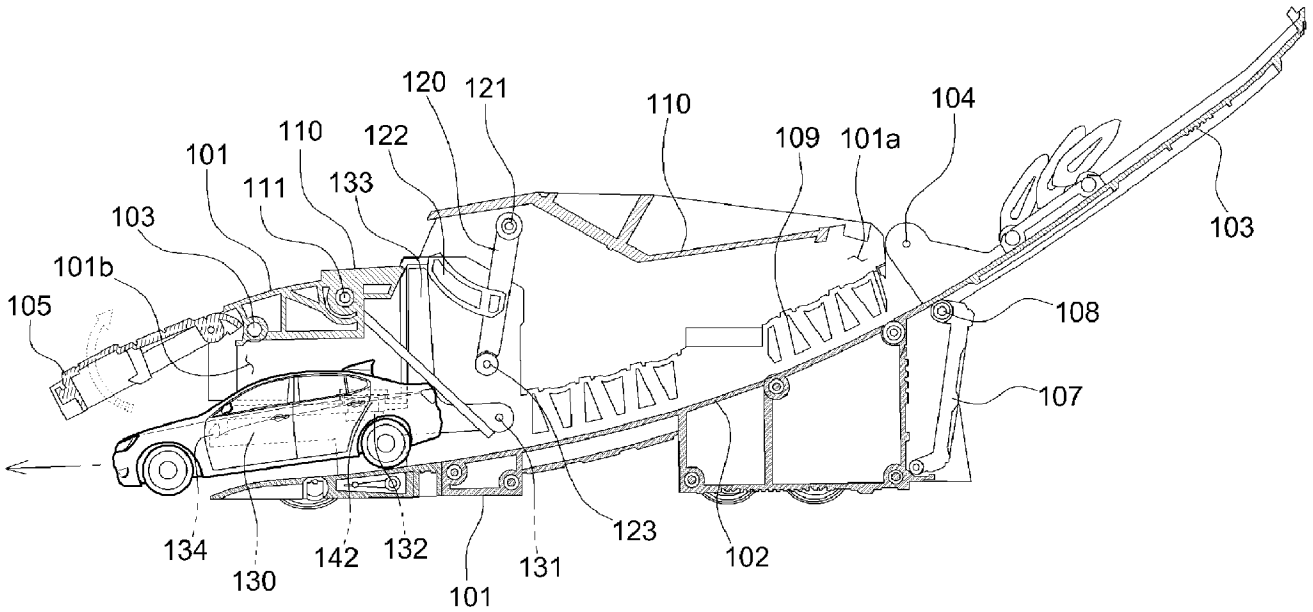
FIG. 5 is a sectional view showing a state where the traveling object of FIG. 4 driven along a slope collides against an impact bar and thus starts to transform.

As shown in FIG. 5, the traveling object 10 driven along the inclined slope 102 collides against an impact bar 123 at the interior of the transforming toy 100, and the rods 120 rotate around the shaft 121 in the clockwise direction.

As the rods 120 rotate, the push rods 122 disposed on one side of the rods 120 push the handles 133 of the locking bars 130, and accordingly, the locking bars 130 rotate around the shafts 131.

As the handles 133 rotate around the shafts 131, the curvedly shaped push rods 122 of the rods 120 slide over the handles 133 and rotate to release the restraint of the head frame 110 rotating in a counter-clockwise direction around the shafts 111.

Even if not shown, the push rods 122 of the rods 120 hinge-fastened to the head frame 110 are locked onto protrusions (not shown) formed on the main body 101 to restrain the rotation of the head frame 110.

As the rods 120 rotate through the collision of the traveling object 10 against the impact bar 123, the push rods 122 rotate together with the rods 120 and are thus unlocked from the protrusions (not shown), so that the restraint of the push rods 122 is released.

Figure 6:
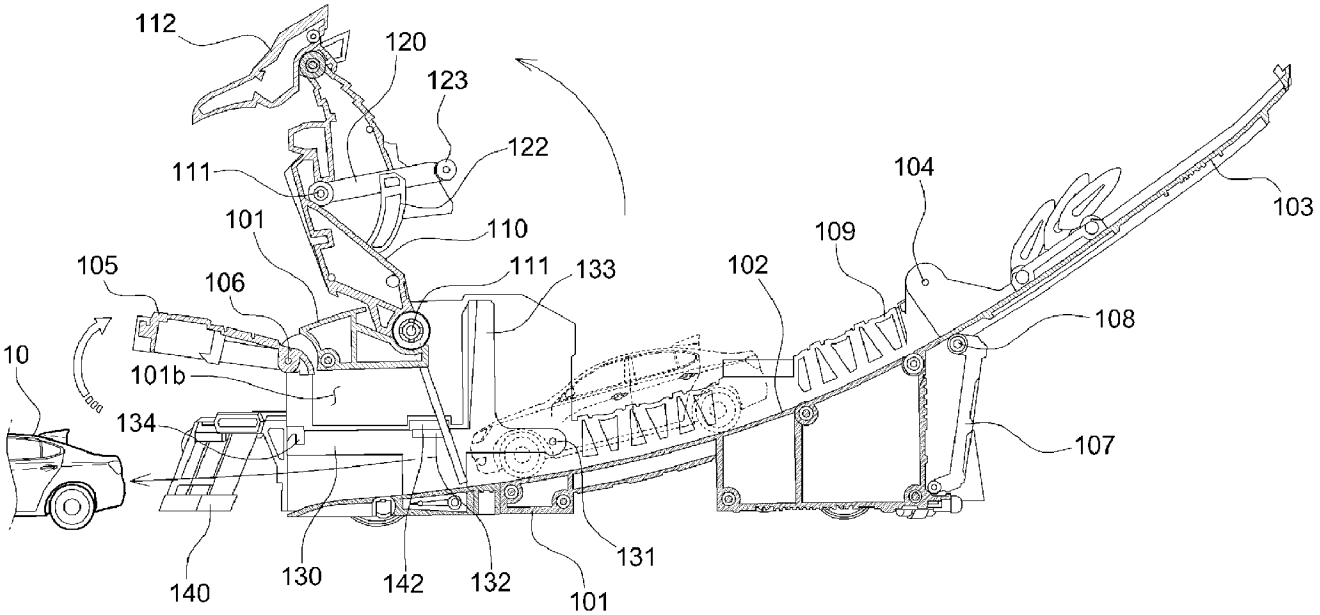
FIG. 6 is a sectional view showing a state where the transforming toy according to the first embodiment starts to transform to develop a head frame and to open doors to launch the traveling object driven along the slope.

As the restraint of the head frame 110 is released, the head frame 110 rotates in the counter-clockwise direction around the shaft 111 to allow a head 112 to protrude upwardly therefrom, as shown in FIG. 6.

As the locking bars 130 rotate around the shafts 131, further, the door locking parts 134 disposed on the end portions of the locking bars 130 release the restraint of the door 105, and as the door 105 rotates around the shaft 106, as shown in FIG. 6, it is open to allow the traveling object outlet 101*b* to be open.

Figure 7:
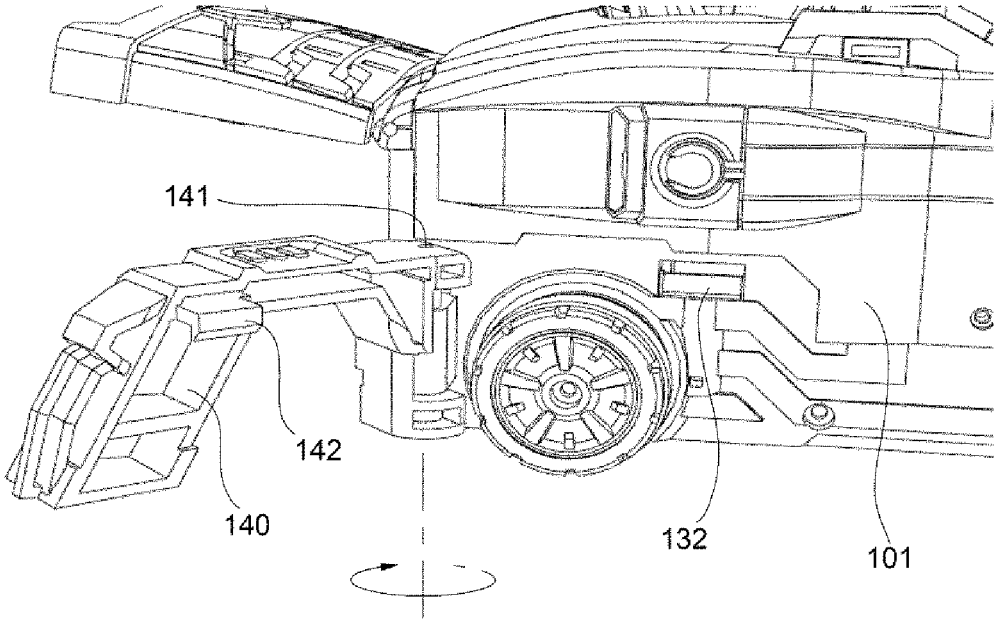
FIG. 7 is a sectional view showing a state where the transforming toy according to the first embodiment starts to transform to allow front legs to protrude therefrom.

As shown in FIG. 7, the front leg lock 142 protruding from one side of each front leg 140 is locked onto the front leg locking part 132 disposed on the intermediate portion of each locking bar 130 as shown in FIG. 2 to allow the front leg 140 to be fixedly contacted with one side of the transforming toy 100, but the traveling object 10 is driven along the slope 102 to push the rods 120, so that the locking bars 130 rotate in the counter-clockwise direction around the shafts 131. At the same time, the front leg locks 142 of the front legs 140 are escaped from the front leg locking parts 132 of the locking bars 130, and as shown in FIG. 7, the front legs 140 rotate around the shafts 141 and are thus developed.

Figure 11:
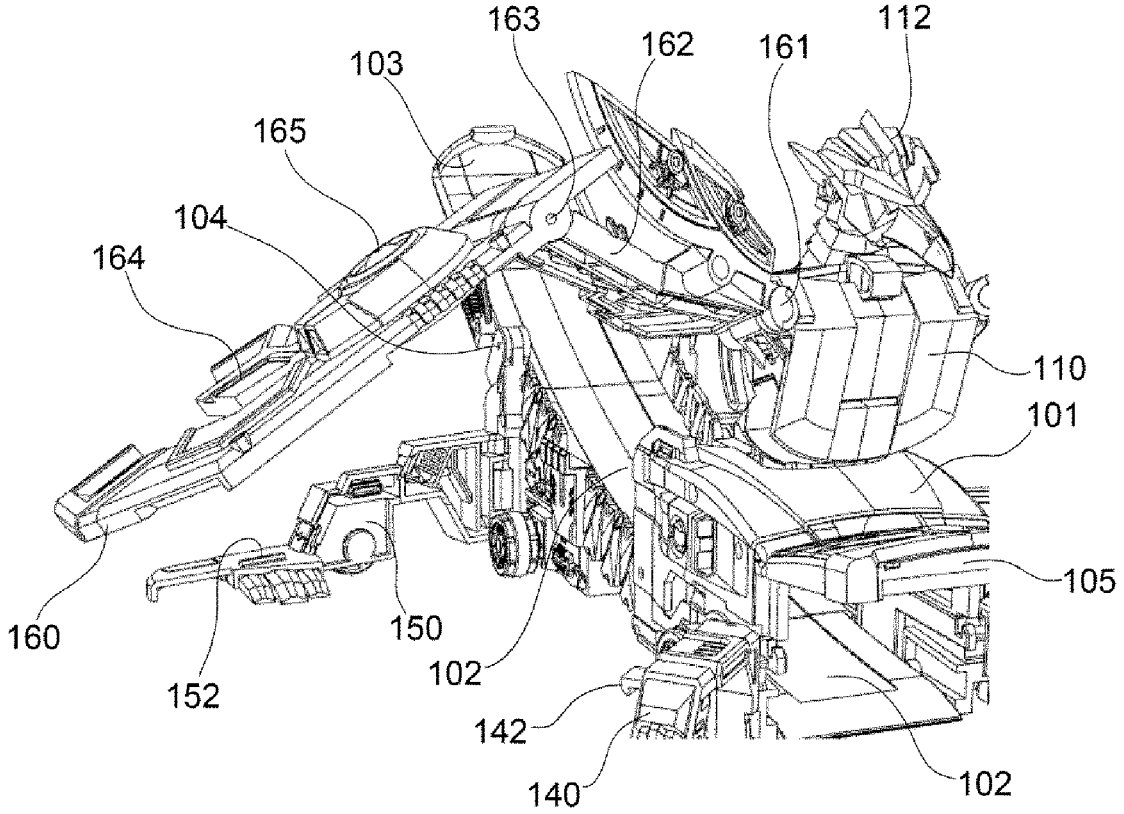
FIG. 11 is a perspective view showing a state where the transforming toy according to the first embodiment transforms to allow the wing and the rear leg to be unfolded.
Figure 12:
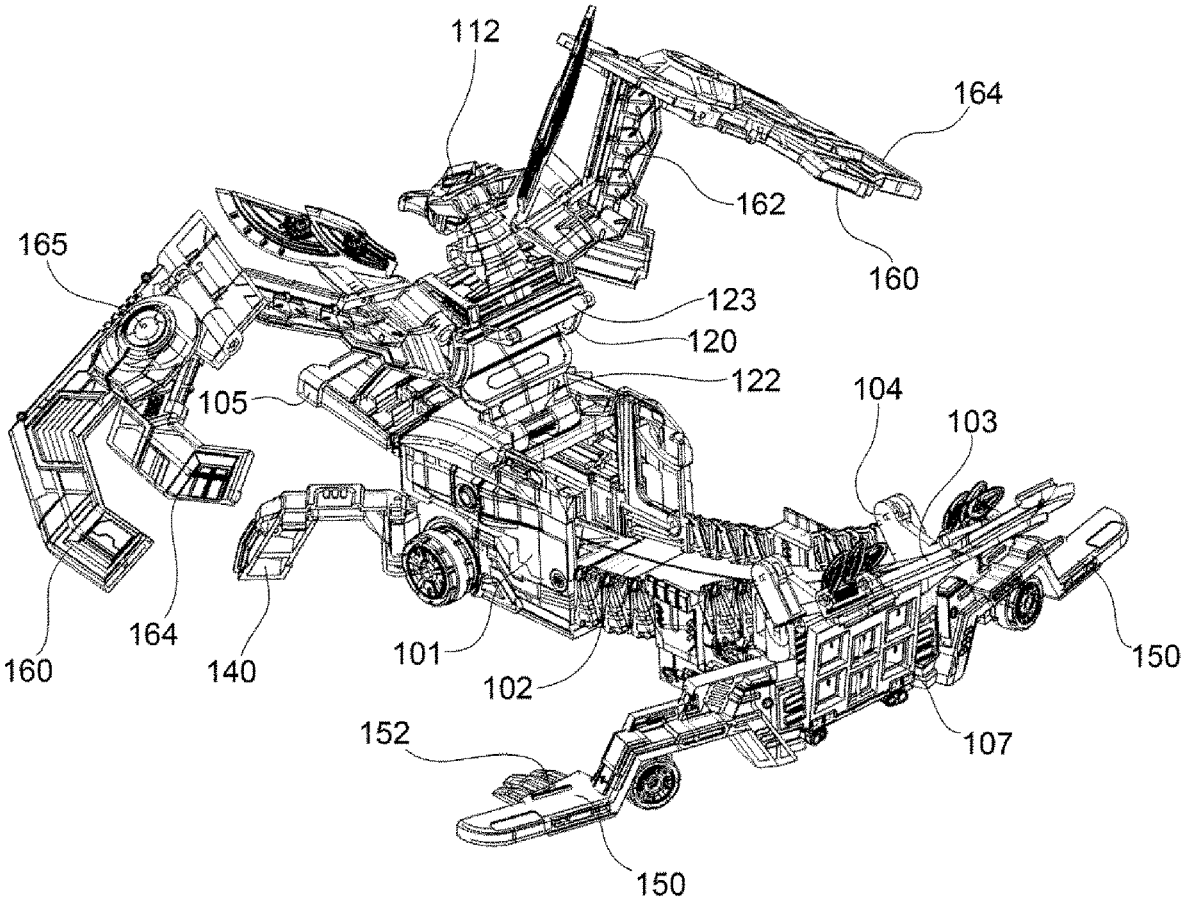
FIG. 12 is a perspective view showing a state where the transforming toy according to the first embodiment has completely transformed.

According to the first embodiment of the present invention, if the transforming toy 100 transforms, as shown in FIGS. 11 and 12, the rear legs 150 are also open like the front legs 140, and at the same time, the wings 160 are unfolded.

Now, transformation operations of unfolding the wings 160 and the rear legs 150 will be explained.

Figure 8:
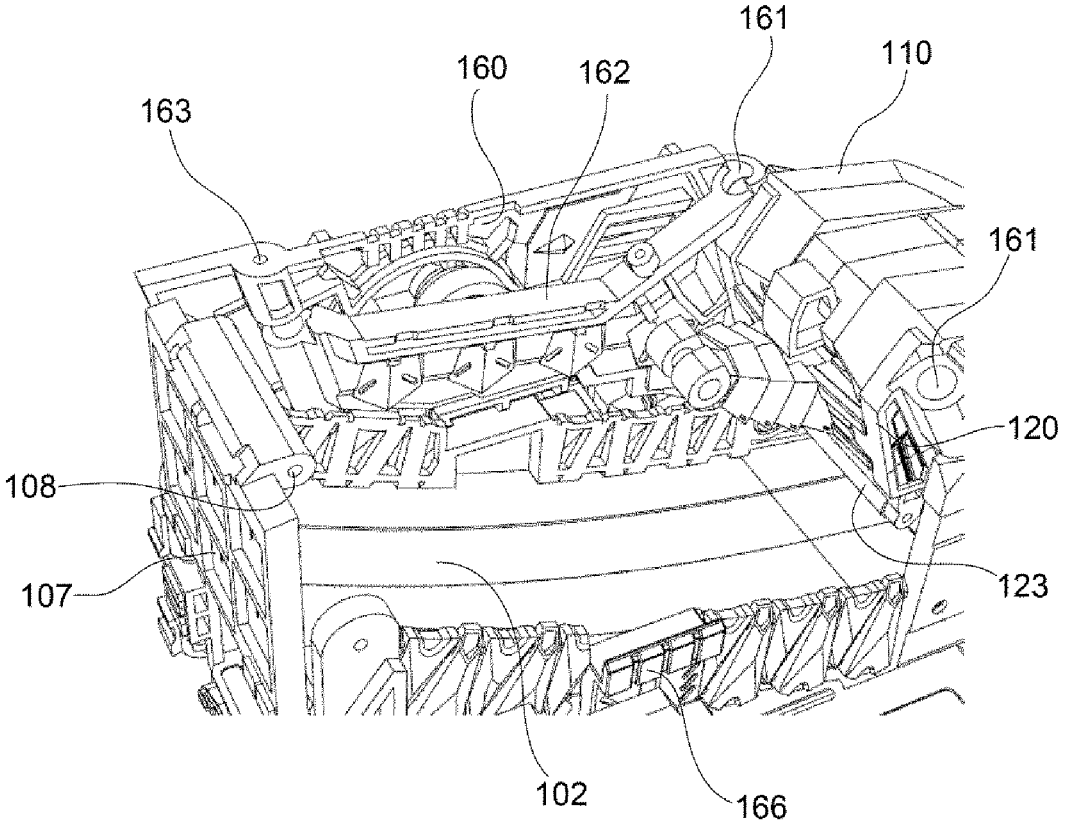
FIG. 8 is a partially exploded perspective view showing an internal state where wings of the transforming toy according to the first embodiment are folded.

As shown in FIG. 8, one side end portion of a wing arm 162 for supporting each wing 160 is hinge-fastened to the head frame 110 by means of the shaft 161, and the other side end portion thereof is hinge-fastened to the wing 160 by means of the shaft 163.

Figure 9:
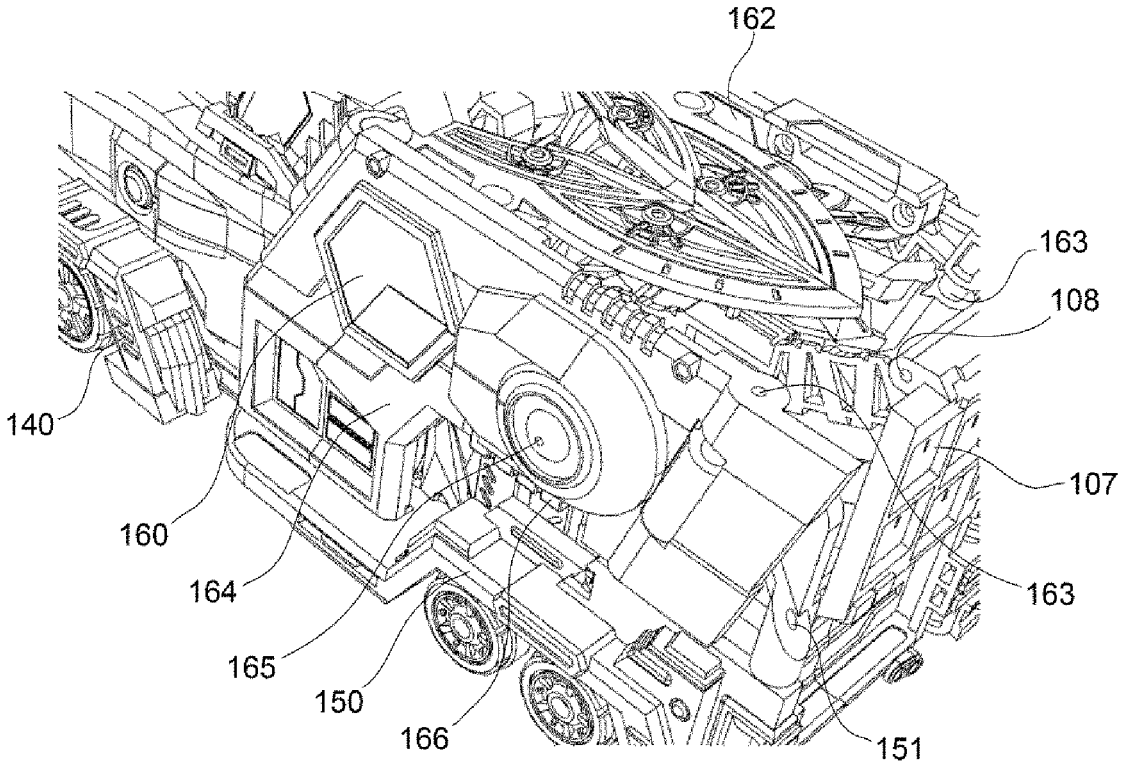
FIG. 9 is a partially exploded perspective view showing an external state where wings of the transforming toy according to the first embodiment are folded.

Further, as shown in FIG. 9, the wing 60 having the shape of a plane is divided to form an auxiliary wing 164, and the auxiliary wing 164 is hinge-fastened to the wing 160 by means of the shaft 165 in such a manner as to come into contact with one side of the transforming toy 100.

The shafts 161, 164 and 165 to which the torsion springs are fitted receive rotary forces so that they are unfolded through the rotary forces, and as shown in FIGS. 8 and 9, the folded wings 160 are locked onto wing locking parts 166 protruding from both sides of the main body 101 of the transforming toy 100, so that they are fixed to the wing locking parts 166 in folded states.

By the way, the traveling object 10 driven along the inclined slope 102 collides against the rods 120 to cause the push rods 122 of the rods 120 to slide over the handles 133 of the locking bars 130, and accordingly, the restraint of the rotary force of the head frame 110 around the shaft 111 is released, as shown in FIG. 6, so that the head frame 110 rotates around the shaft 111 and is thus open.

Figure 22:
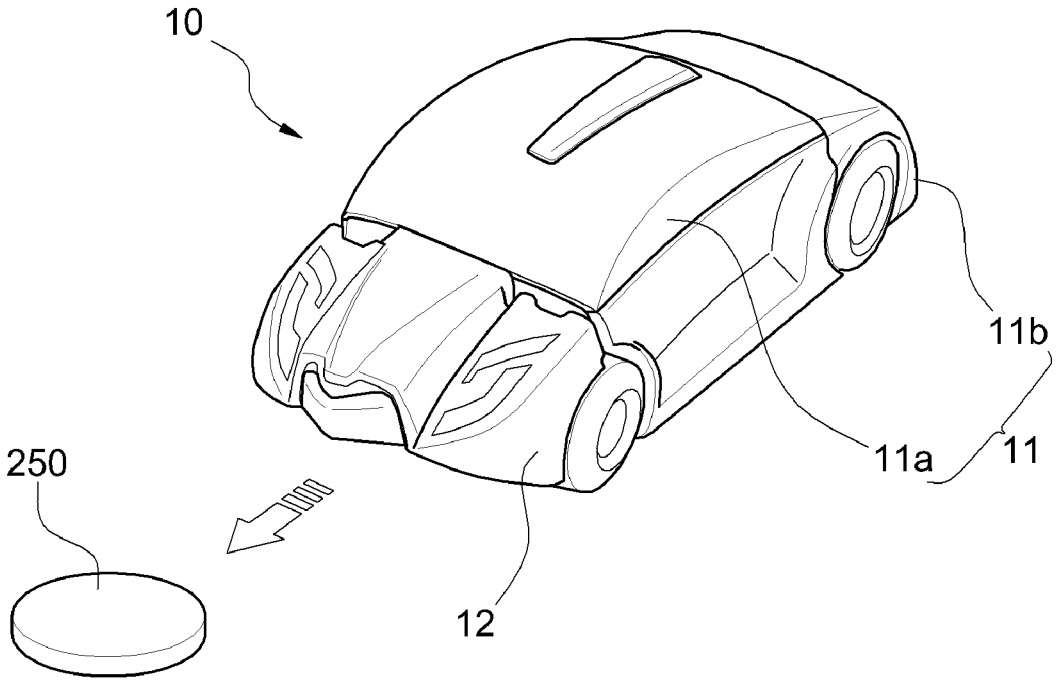
FIG. 22 is a perspective view showing the traveling object.

At this time, as shown in FIG. 8, the wing arms 162 hinge-fastened to the head frame 110 rotate around the shaft 111 of the head frame 110, and the wings 160 hinge-fastened to the wing arms 162 by means of the shafts 163 also rotate together with the head frame 110. As a result, the wings 160 are escaped from the wing locking parts 166 disposed on the main body 101, and as shown in FIG. 22, the wings 160 are unfolded.

As shown in FIG. 12, the rear legs 150 are hinge-fastened to the main body 101 by means of the shafts 151 and receive forces from the torsion springs so that they are unfolded.

Figure 10:
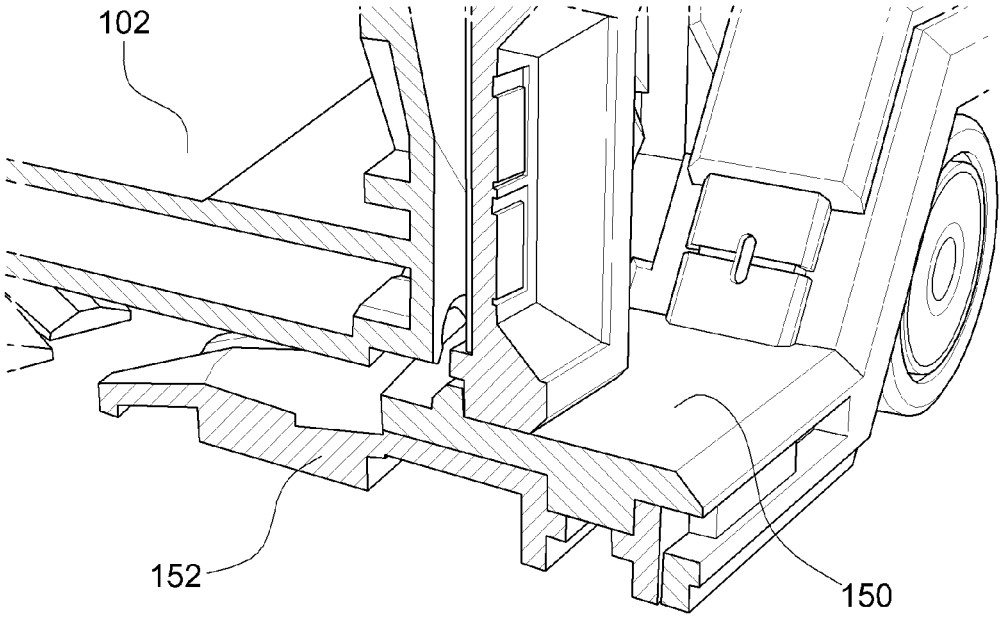
FIG. 10 is a perspective view showing a partial section of the state where the wing of the transforming toy according to the first embodiment restrains a rear leg.

Before the wings 160 are unfolded, by the way, the wings 160 are located on tops of the rear legs 150 folded and are locked onto rear leg locking parts 152 protruding from the tops of the rear legs 150 to restrain the unfolding operations of the rear legs 150, as shown in FIG. 10.

As mentioned above, the head frame 110 protrudes upwardly to allow the wings 160 restraining the rear legs 150 to operate cooperatively therewith and protrude upwardly, so that the wings 160 are unfolded. Accordingly, the rear legs 150 released from the restraint of the wings 160 rotate around the shafts 151, and as shown in FIG. 12, they are unfolded.

According to the first embodiment of the present invention, the transforming toy 100 starts to transform when the traveling object 10 having a given mass is driven along the inclined slope 101 at the inside thereof from the traveling object inlet 101*a* toward the traveling object outlet 101*b* and then collides against the impact bar 123, and in this case, the driving speed of the traveling object 10 is reduced by the collision of the traveling object 10 against the impact bar 123.

At this time, the impact bar 123 has a roller (not shown) mounded thereon, desirably, the roller of the impact bar 123 gently slides over the external surface of the traveling object 10 when the traveling object 10 collides against the impact bar 123.

According to the first embodiment of the present invention, if the traveling object 10 is driven along the inclined slope 102 disposed inside the transforming toy 100, it collides against the impact bar 123 inside the transforming toy 100 to allow the head frame 110 to protrude upwardly, to allow the wings 160 to be unfolded, and to allow the front legs 140 and the rear legs 160 to be at the same time unfolded, so that the transforming toy 100 having the form of the car transforms into a given robot form.

Simultaneously, the door 105 at the front side of the transforming robot is open to permit the traveling object 10 to be launched therefrom.

According to the first embodiment of the present invention, that is, the head frame 110, the door 105, the front legs 140, the rear legs 150, and the wings 160 are transforming bodies, the locking parts for restraining their development are the locking bars 130 and the handles 133, and the rods 120 serve as the transformation operating part for releasing the locking parts of the transforming bodies to develop the transforming bodies.

Second Embodiment

Figure 13:
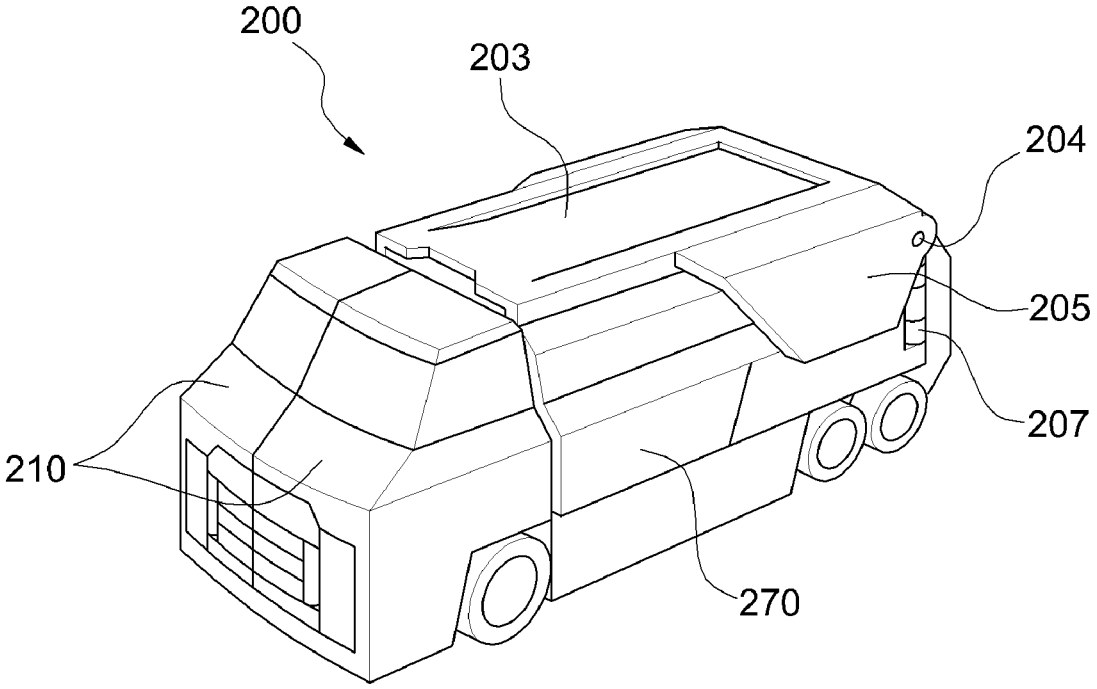
FIG. 13 is a perspective view showing a state before a multi-step transforming toy according to a second embodiment transforms.
Figure 14:
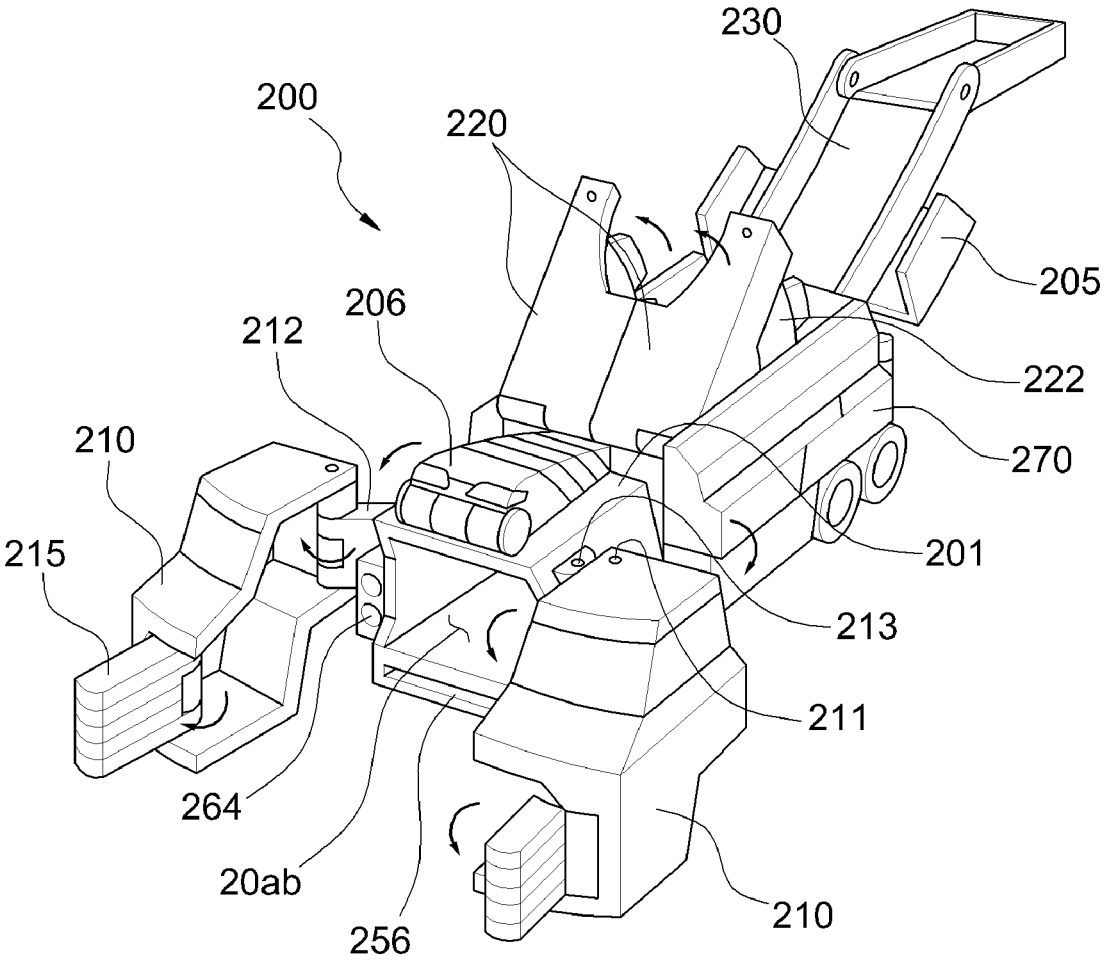
FIG. 14 is a perspective view showing a state where the multi-step transforming toy according to the second embodiment completes first transformation.
Figure 15:
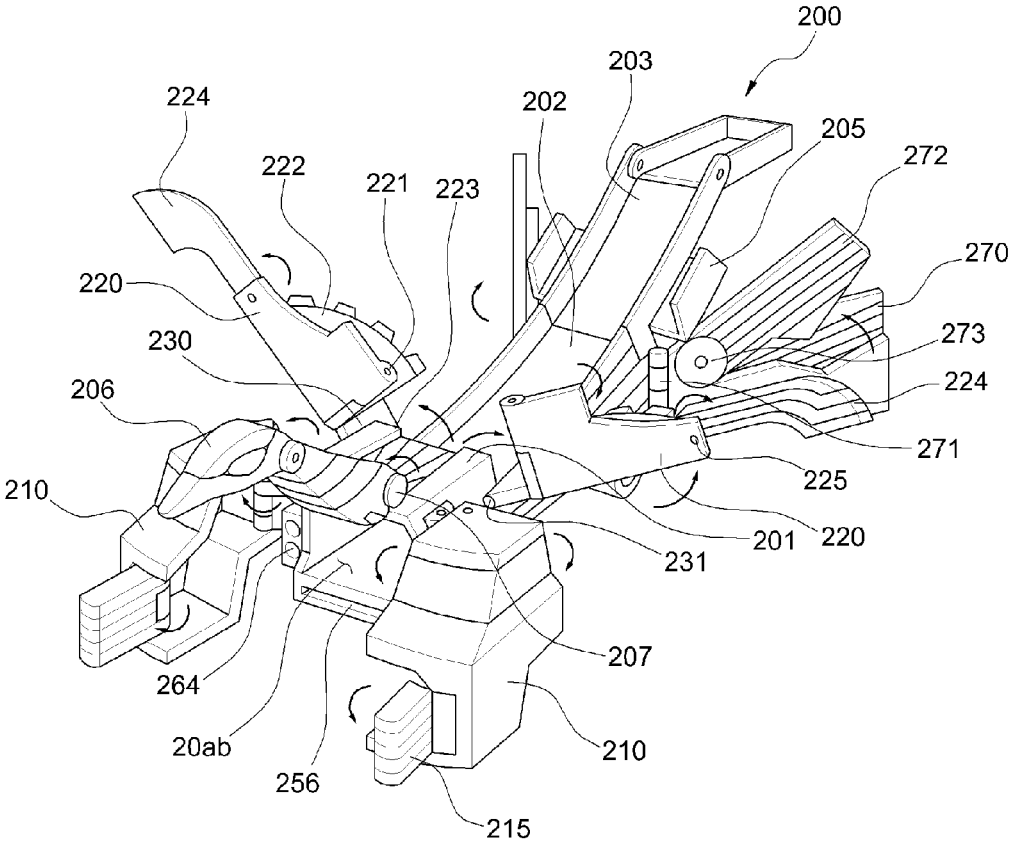
FIG. 15 is a perspective view showing a state where the multi-step transforming toy according to the second embodiment has completely transformed.

As shown in FIG. 13, a transforming toy according to a second embodiment of the present invention has a shape of a truck before transforms. If the transforming toy transforms into a first form, as shown in FIG. 14, it transforms into a scorpion, and if it transforms into a second form, as shown in FIG. 15, it transforms into a pterosaur. The original form, the first form, and the second form are just examples, and of course, they may be changed into designed different forms, such as airplane, car, train, and ship as transportation means, robot, dinosaur, and given character.

As shown in FIG. 13, the transforming toy 200 having the original form transforms into the first form so as to launch a traveling object, and in a process where the traveling object is launched, the transforming toy 200 finally transforms into the second form.

Now, an explanation on the transformation into the first form will be given below.

As shown in FIGS. 13 and 14, a slope cover 203 hinge-fastened to the rear side of a main body 201 of the transforming toy 200 is open by a user to rotate upwardly first transformation operating parts 220 located on an upper portion of the main body 201.

If the first transformation operating parts 220 rotate upwardly by means of the user, as shown in FIG. 14, doors 210 disposed on the front side of the transforming toy 200 are open to rotate hands 215 accommodated in the doors 210, so that the hands 215 protrude from the doors 210.

Figure 16:
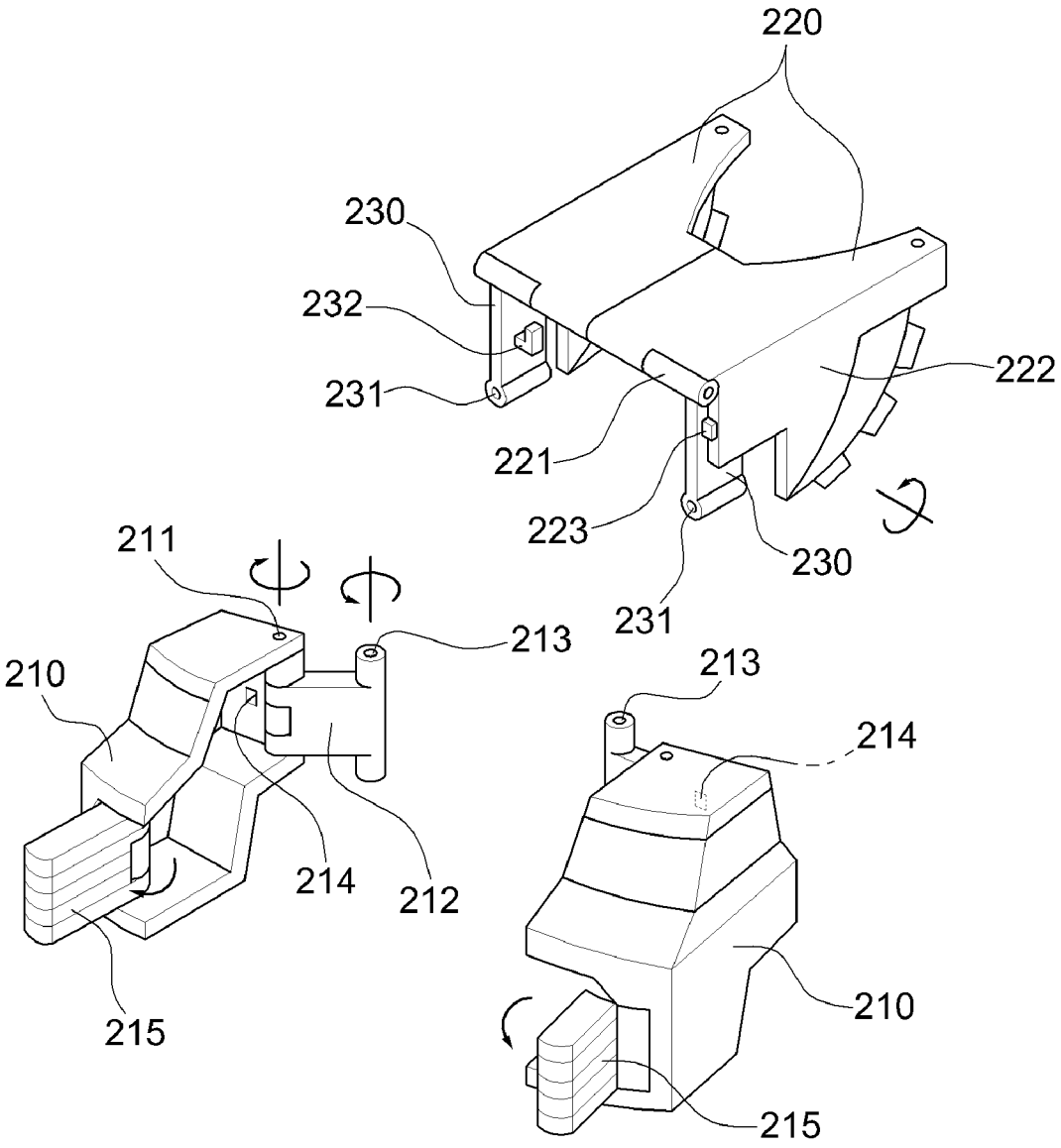
FIG. 16 is a partially perspective view showing parts for performing the first transformation in the multi-step transforming toy according to the second embodiment.

In more detail, as shown in FIG. 16, transforming bodies 230 are rotatably fastened to the main body 201 (which is not shown in this figure) on both sides thereof by means of shafts 231 and are fastened to the plate-shaped first transformation operating parts 220 by means of shafts 221 on the other side thereof, so that the first transformation operating parts 220 are rotatable in perpendicular directions to the shafts 231.

The first transformation operating parts 220 are two divided parts around the center thereof and have side plates 222 extended from both side ends thereof and fixing protrusions 223 protruding from the front surfaces of the side plates 222.

Further, as shown in FIG. 16, the doors 210 are two divided parts around the center thereof. Each divided door 210 is rotatably fastened to one side of a developing part 212 by means of a shaft 211, and the other side of the developing part 212 is rotatably fastened to the main body 201 by means of a shaft 213.

Further, the divided doors 210 have fixing slots 214 formed on the rear surfaces thereof.

The shafts 211 and 213 are elastically supported against torsion springs (not shown), and hereinafter, they are defined as 'torque shafts'.

In the state where the transforming toy 200 has the original form as shown in FIG. 13, the rear portions of the divided doors 210 come into contact with the side plates 222, and at this time, as shown in FIG. 16, the fixing protrusions 223 protruding from the side plates 222 are inserted into the fixing slots 214 of the doors 210.

That is, the fixing protrusions 223 protruding from the side plates 222 of the first transformation operating parts 220 serve as first transforming body locking parts for fixing the first transformation operating parts 220 to the doors 210.

In this state, if the first transformation operating parts 220 rotate upwardly by the user, the fixing protrusions 223 of the side plates 222 are escaped from the fixing slots 214 of the doors 210, and accordingly, the doors 210 are developed by means of the elasticity of the torque shafts 211 and 213, so that the transforming toy 200 transforms into the first form as shown in FIG. 14.

After the first transformation is completed, as shown in FIG. 14, a traveling object outlet 201*b* is exposed to the outside on the front side of the main body 201, and a traveling object inlet 201*a* is exposed to the outside on the rear side of the main body 201 in such a manner as to be connected to a slope 202.

According to the second embodiment of the present invention, the first transformation operating parts 220 rotate by the user to perform the transformation into the first form. However, of course, the shafts 221 of the first transformation operating parts 220 are formed of torque shafts, and various known locking parts (not shown) for restraining the rotary motions of the shafts 221 are provided, so that the restraint of the locking parts is released by means of button pressing or switch manipulation to develop the first transformation operating parts 220.

Next, an explanation on the transformation into the second form after the transformation into the first form will be given below.

After the transformation into the first form has been completed, as shown in FIG. 14, if the traveling object having a form of a car is placed on the inclined slope 202, it enters the traveling object inlet 201*a* of the main body 201 by means of gravity and is then launched from the traveling object outlet 201*b*.

At this time, in the process where the traveling object is driven in the interior of the main body 201, it becomes physically contacted with a transformation operating part 240 to release the locking parts for restraining the transforming bodies 230, so that the transformation into the second form is completed.

Figure 17:
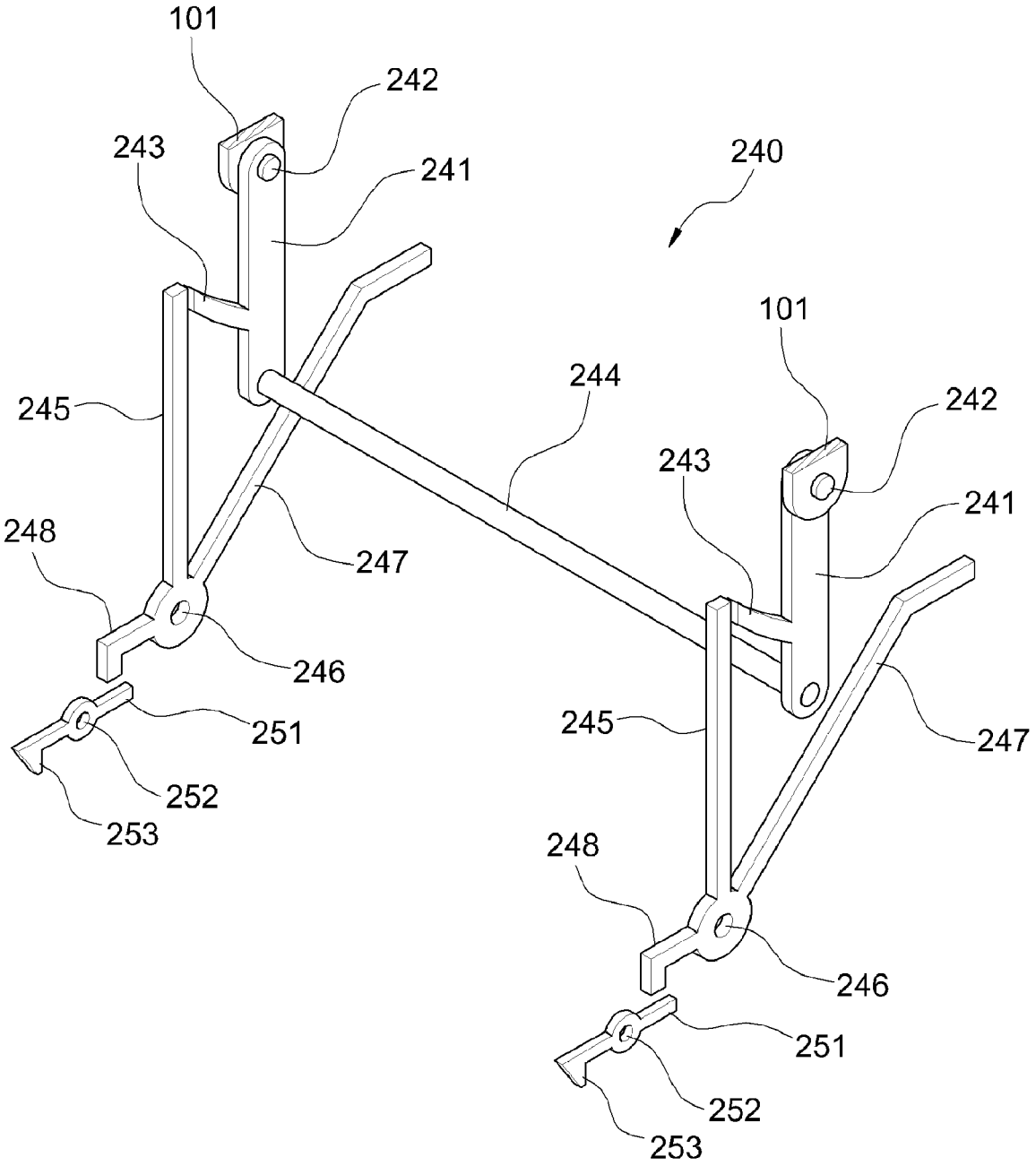
FIG. 17 is a perspective view showing a transformation operating part for performing transformation in the multi-step transforming toy according to the second embodiment.
Figure 18:
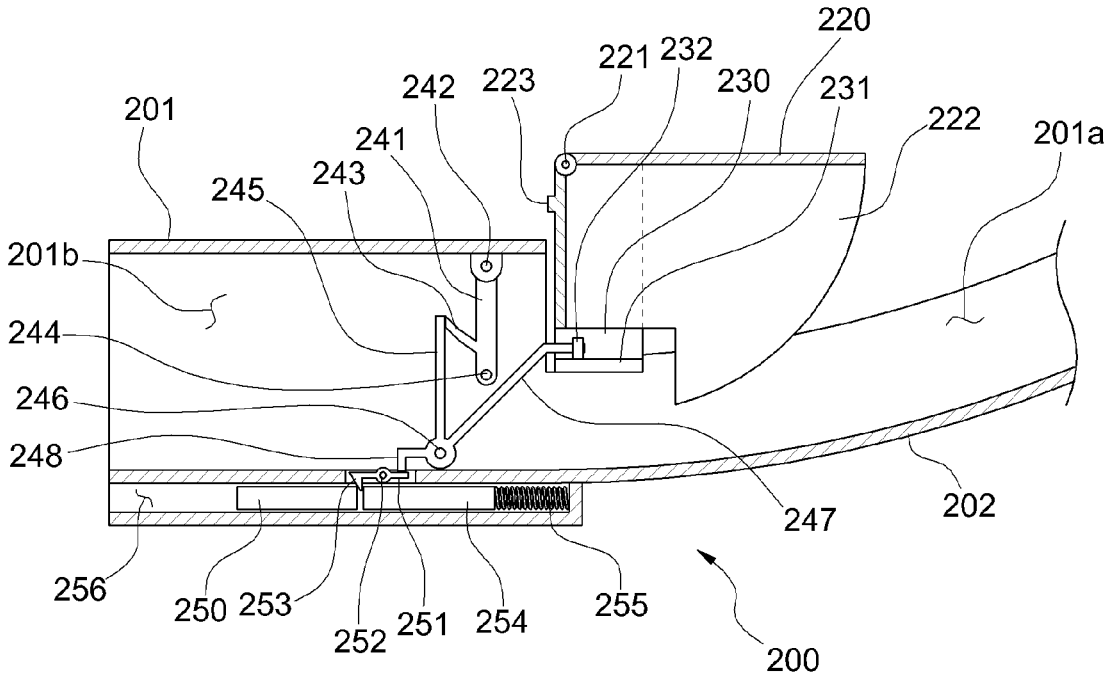
FIGS. 18 to 20 are sectional views showing a transformation inducing item launching part and a transforming process of the multi-step transforming toy according to the second embodiment.

As shown in FIGS. 17 and 18, the transformation operating part 240 has rods 241 rotatably fastened to both sides of upper portions of the interior of the main body 201 by means of shafts 242, push rods 243 protruding laterally from the rods 241, and an impact bar 244 fastened to lower portions of the rods 241 on both ends thereof.

Further, the transformation operating part 240 has bar-shaped handles 245 whose lower portions fastened to both side surfaces of the interior of the main body 201 by means of shafts 246 and whose upper ends coming into contact with the push rods 243.

Furthermore, as shown in FIG. 17, the transformation operating part 240 has locking bars 247 rotating cooperatively with the handles 245. The locking bars 247 are locking parts for restraining the transformation of the transforming toy 200 into the second form.

As shown in FIG. 16, the transforming bodies 230 are rotatably fastened to the main body 201 by means of the torque shafts 231 and have "U"-shaped fixing parts 232 protruding from the surfaces coming into contact with the main body 201.

In the state where the transforming bodies 230 are folded to the main body 201, the fixing parts 232 are inserted into through holes (not shown) formed on side surfaces of the main body 201 and are located in the interior of the main body 201. At this time, the locking bars 247 as shown in FIG. 17 are inserted into the fixing parts 232 to fix the transforming bodies 230 thereto.

Figure 19:
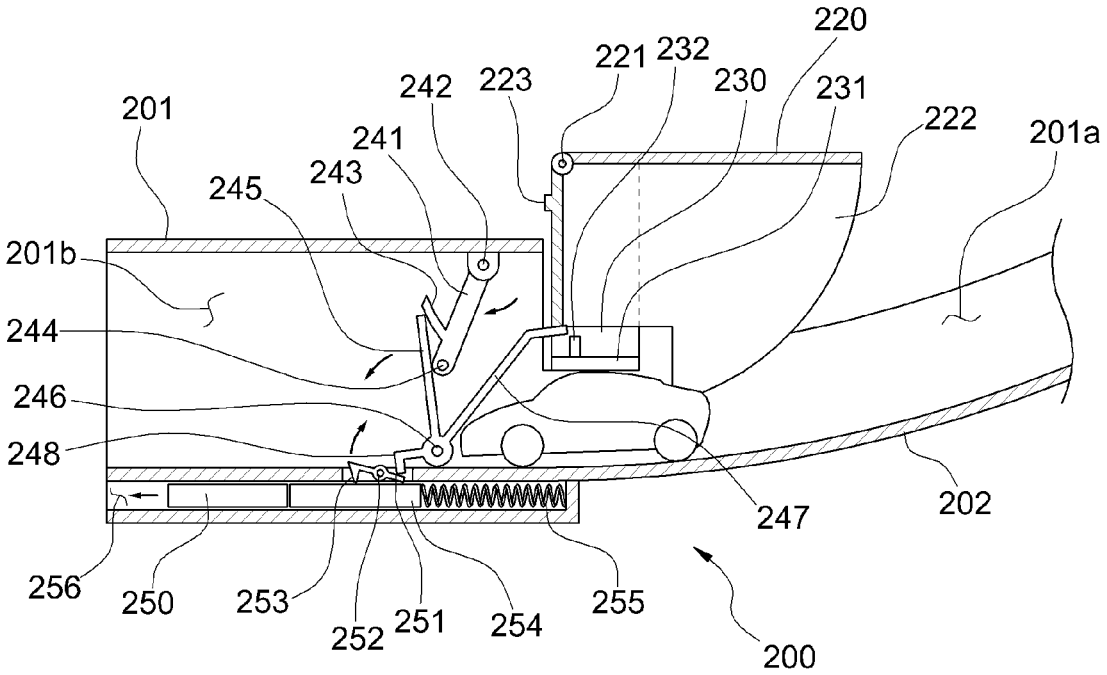

If the traveling object is placed on the slope 202 as shown in FIG. 18, it is driven in the interior of the main body 201 along the slope 202, and as shown in FIG. 19, it collides against the impact bar 244 traversing the interior of the main body 201 and is thus escaped from the traveling object outlet 201*b* of the main body 201.

The impact bar 244 rotates the rods 241 through the collision with the traveling object, and the push rods 243 protruding laterally from the rods 241 push the handles 245 to allow the handles 245 to rotate around the shafts 246.

At this time, the locking bars 247 adapted to rotate around the same shafts 246 as the handles 245 rotate and are thus escaped from the fixing parts 232 of the transforming bodies 230 to allow the locking states of the transforming bodies 230 to be released.

If the locking states of the transforming bodies 230 are released, as shown in FIG. 15, the transforming bodies 230 rotatably fastened to the main body 201 by means of the torque shafts 231 rotate around the torque shafts 231 and are thus developed.

Further, in the process where the first transformation operating parts 220 as shown in FIG. 15 are open to both sides, wings 224 fastened to the first transformation operating parts 220 by means of torque shafts 225 rotate and are thus developed.

Furthermore, in the process where the first transformation operating parts 220 as shown in FIG. 15 are open to both sides, a head 206 fixed by pressing the first transformation operating parts 220 rotates around a torque shaft 207 and is thus developed.

Before the first transformation operating parts 220 are open to both sides, the side plates 222 thereof fixedly press folded rear wings 270 fastened to the rear side of the main body 201 by means of torque shafts 271, and if the first transformation operating parts 220 are open to both sides, as shown in FIG. 15, the locking states of the rear wings 270 are released, so that the rear wings 270 rotate around the torque shafts 271 and are thus developed.

As the rear wings 270 are developed, an auxiliary wing 272 fastened to the rear wings 270 by means a torque shaft 273 is developed to complete the transformation into the pterosaur as shown in FIG. 15.

According to the second embodiment of the present invention, the transformation into the first form is carried out in the step where the launch for the traveling object is ready, and while the traveling object is being launched, the transformation into the second form is carried out.

According to the second embodiment of the present invention, the transforming toy 200 in the process of the transformation into the second form has a launching part for launching objects 260 having various shapes like missiles, pterosaurs, and so on.

Figure 21:
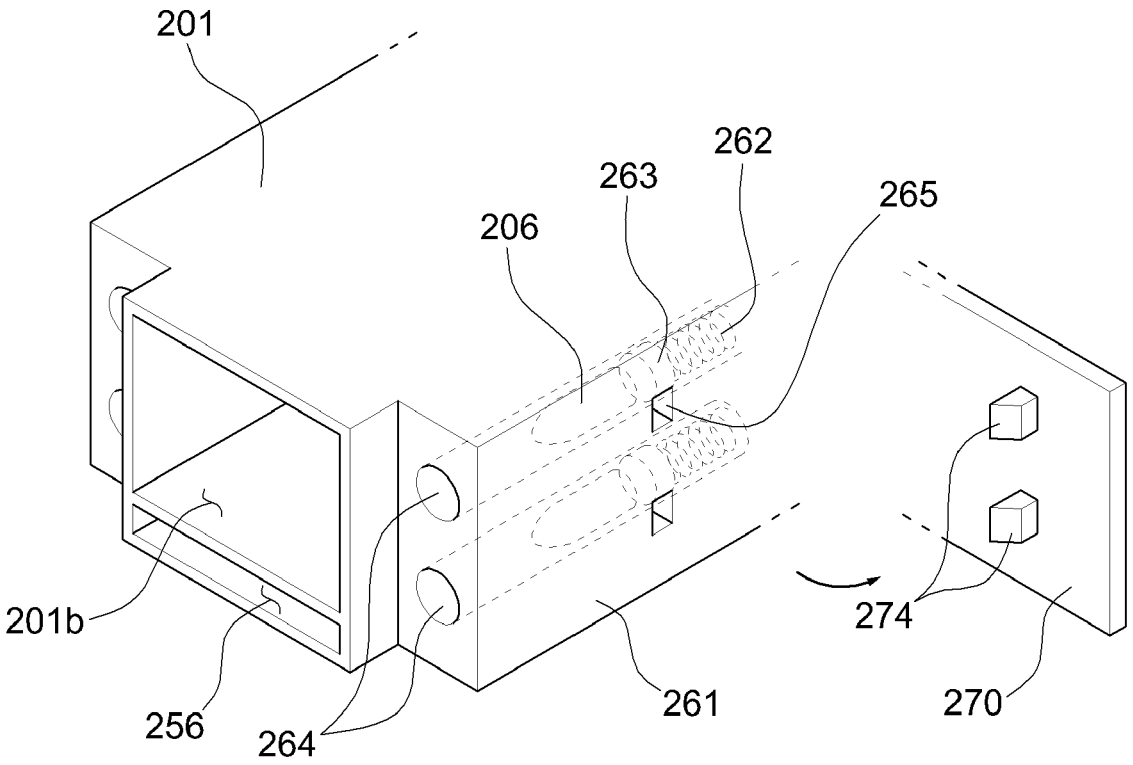
FIG. 21 is a perspective view showing a portion of an item launching part in the multi-step transforming toy according to the second embodiment.

As shown in FIGS. 14, 15 and 21, the launching part includes launching part bodies 261 disposed on both sides of the main body 210 to launch the launching objects 260, and the launching part allows the transforming bodies 230 to be developed to launch the launching objects 260.

As shown in FIG. 21, the launching part includes the launching part bodies 261 disposed on the main body 210, launching holes 264 formed on the front side of each launching part body 261 to insert and launch the launching objects 260 thereinto, and firing pins 263 disposed in the interiors of the launching holes 264 in such a manner as to be elastically supported against springs 262.

Each firing pin 263 is fixed to the end of the spring 262, and after the spring 262 is compressed and fixed to a locking part, the locking state of the spring 262 is released by the developing operations of the transforming bodies 230 as shown in FIG. 16, so that the spring 262 is elastically returned to its original shape to allow the firing pin 263 to push and launch the corresponding launching object 260.

The locking part for fixing the firing pin 263 at the state where the spring 262 is compressed is configured as follows.

The rear wings 270 are developed in the transformation into the second form, and before developed, in this case, they are folded to the side surfaces of the launching part bodies 261.

Stoppers 274 protrude from the surface of each rear wing 270 coming into contact with the launching part, and fixing holes 265 are pierced into the launching holes 264 corresponding to the front sides of the firing pins 263 at positions where the springs 262 of the launching part are compressed.

In the state where the rear wings 270 are folded (in the state where the transforming toy 200 has the original form or the first form), the stoppers 274 of each rear wing 270 are inserted into the launching holes 264 through the fixing holes 265 and are located in front of the firing pins 263. Even if the springs 262 are compressed, accordingly, the firing pins 263 are restrained by the stoppers 274.

In the process where the transformation into the second form is carried out, the rear wings 270 developedly rotate around the torque shafts 271, as shown in FIG. 15, and the stoppers 274 of the rear wings 270 are separated from the fixing holes 265 to release the locking states of the firing pins 263, as shown in FIG. 21, so that the firing pins 263 push and launch the launching objects 260 by means of the elastic restoring forces of the springs 262.

According to the second embodiment of the present invention, the stoppers 274 of the rear wings 270 serve as the locking parts of the launching part, but locking parts for the developed parts (for example, the transforming bodies 230 of FIGS. 15 and 16) in the transformation into the second form are provided to release the locking state of the launching part in the transformation into the second form, so that the launching objects 260 are launched.

Further, the transforming toy 200 has the traveling object actuating the transformation operating part 240 in such a manner as to be transformable. That is, a transformation inducing item 250 for inducing the transformation of the traveling object is launched, so that when the traveling object driven approaches the transformation inducing item 250, it can transform.

The transformation inducing item 250 releases a transformation locking part of the traveling object launched to induce the transformation of the traveling object. The transformation locking part of the traveling object will be in detail explained later.

As shown in FIGS. 15 and 18, a transformation inducing item launching part is located on the underside of the main body 201.

As shown in FIG. 18, the transformation inducing item launching part includes an item launching hole 256 formed on the underside of the main body 201 to insert the transformation inducing item 250 thereinto and a firing pin 254 disposed in the item launching hole 256 in such a manner as to be elastically supported against a spring 255.

The firing pin 254 is fixed to the end of the spring 255, and after the spring 255 is compressed and fixed to a locking part, the spring 255 is elastically restored to its original location by means of the developing operations of the transforming bodies 230, so that the firing pin 254 pushes and launches the transformation inducing item 250 by means of the elastic restoring force of the spring 255.

The locking part for fixing the firing pin 254 at the state where the spring 255 is compressed is configured as follows.

As shown in FIGS. 18 and 19, the locking part for fixing the firing pin 254 includes operating members 248 rotating cooperatively with the handles 245 of the transformation operating part 240 around the shafts 246.

Further, the locking part includes holes (not shown) piercedly formed on positions corresponding to the operating members 246 to communicate with the item launching hole 256 of the transformation inducing item launching part.

Torque shafts 252 each having a launcher 252 protruding from one side thereof and a stopper 253 protruding from the other side thereof are disposed in the holes (not shown). At this time, as shown in FIG. 18, the launchers 251 are disposed to come into contact with the operating members 248.

Figure 20:
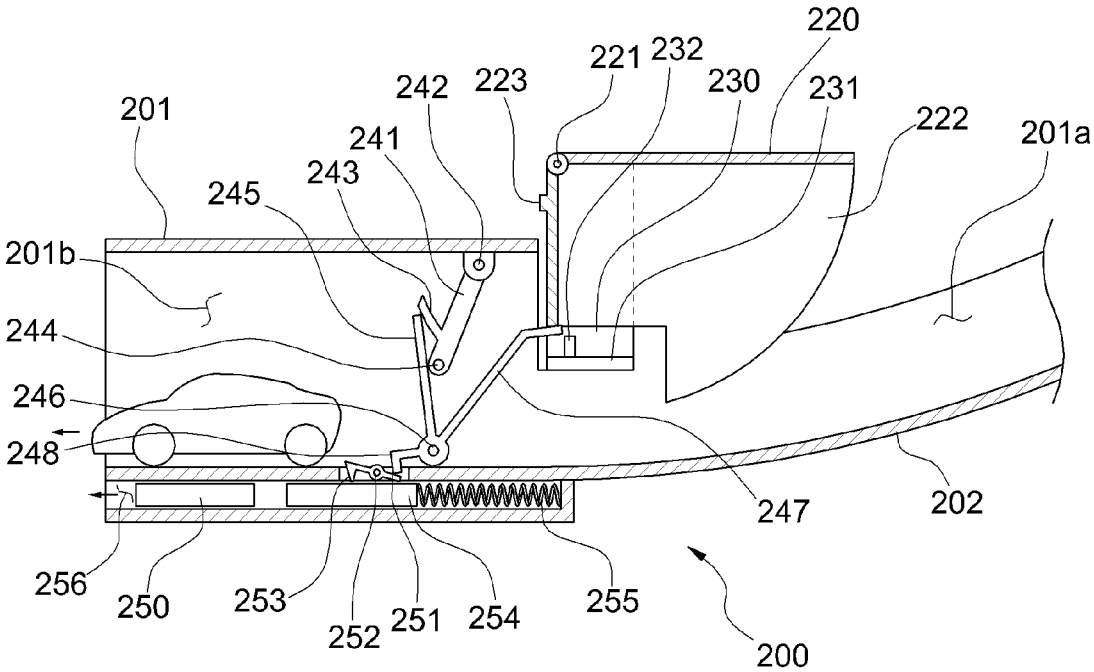

As shown in FIGS. 18 to 20, if the traveling object slides along the slope 202 to collide against the impact bar 244 of the transformation operating part 240, the push rods 243 push and rotate the handles 245, and at this time, the operating members 248 rotating cooperatively with the handles 245 rotate around the shafts 246 to pressurize the launchers 251.

The launchers 251 rotate around the shafts 252 to rotate the stoppers 253 upwardly, so that the locking states of the stoppers 253 restraining the firing pins 254 are released.

The locking states of the stoppers 253 are released to allow the firing pins 254 to push and launch the transformation inducing item 250 by means of the elastic restoring forces of the springs 255.

As the transformation inducing item 250 is launched by means of the elastic restoring forces of the springs 255, it moves ahead of the traveling object and stops by friction against the ground, and if the traveling object driven comes into contact with the transformation inducing item 250, the transformation locking part of the traveling object is released from the locking state thereof by means of the transformation inducing item 250, so that the traveling object can transform into another form.

According to the second embodiment of the present invention, the transformation inducing item 250 is plate-shaped, but it may have various shapes such as a sphere, cube, ring, corn, airplane, car, train, ship, robot, dinosaur, and given character.

The traveling object 10 transforming through the contact with the transformation inducing item 250 is configured as follows.

According to the second embodiment of the present invention, the traveling object 10 has a form of a car having wheels driven along the inclined slope 102.

Figure 23:
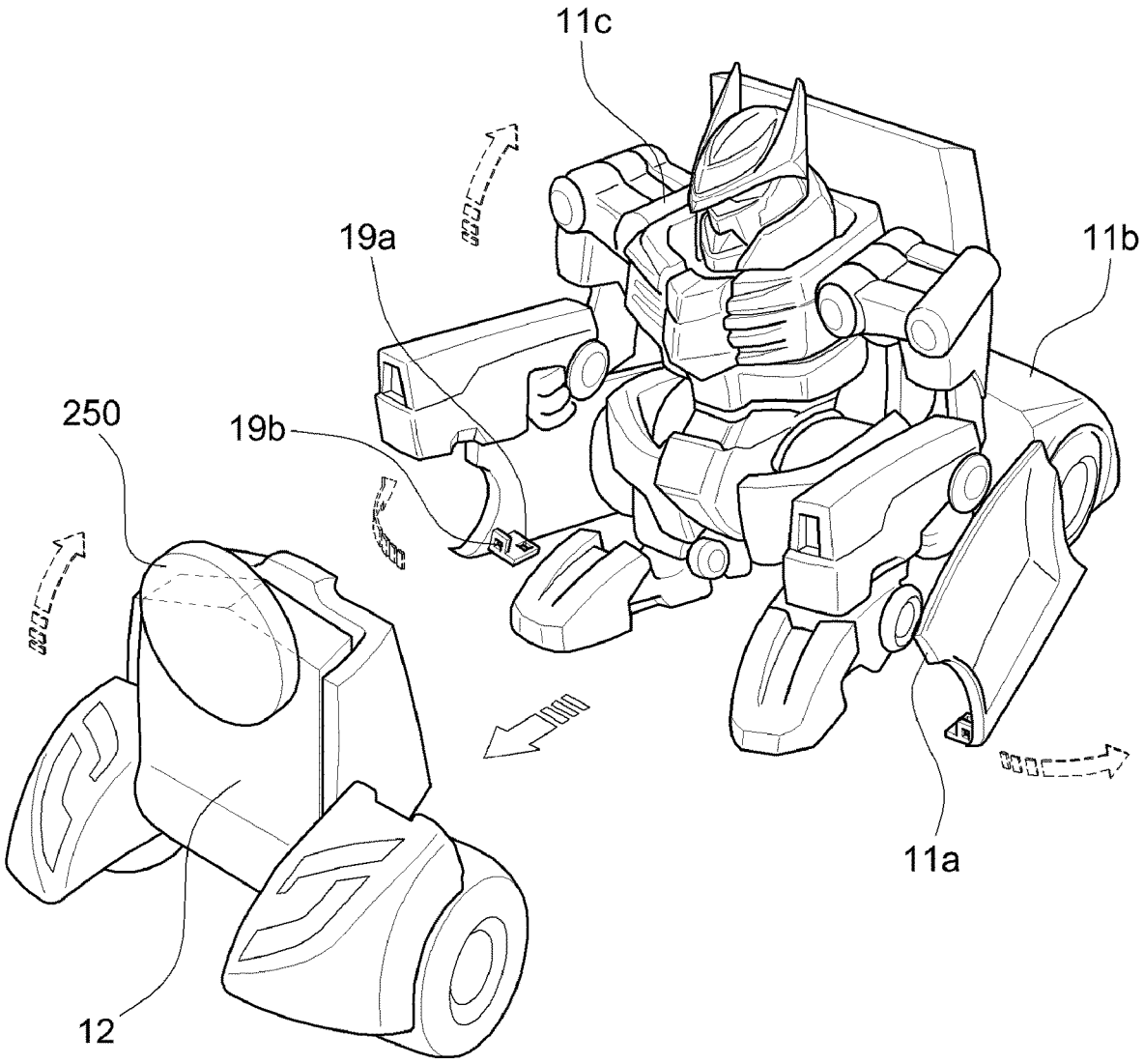
FIG. 23 is a perspective view showing the traveling object transformed.

As shown in FIG. 22, the traveling object 10 includes a body 11 and a separable body 12, and if it is launched from the transforming toy 200 and is thus driven to come into contact with the transformation inducing item 250 launched from the transformation inducing item launching part, the locking part of the traveling object 10 is released from the locking state thereof to allow the traveling object 10 to transform into the form as shown in FIG. 23 from the form as shown in FIG. 22.

Figure 24:
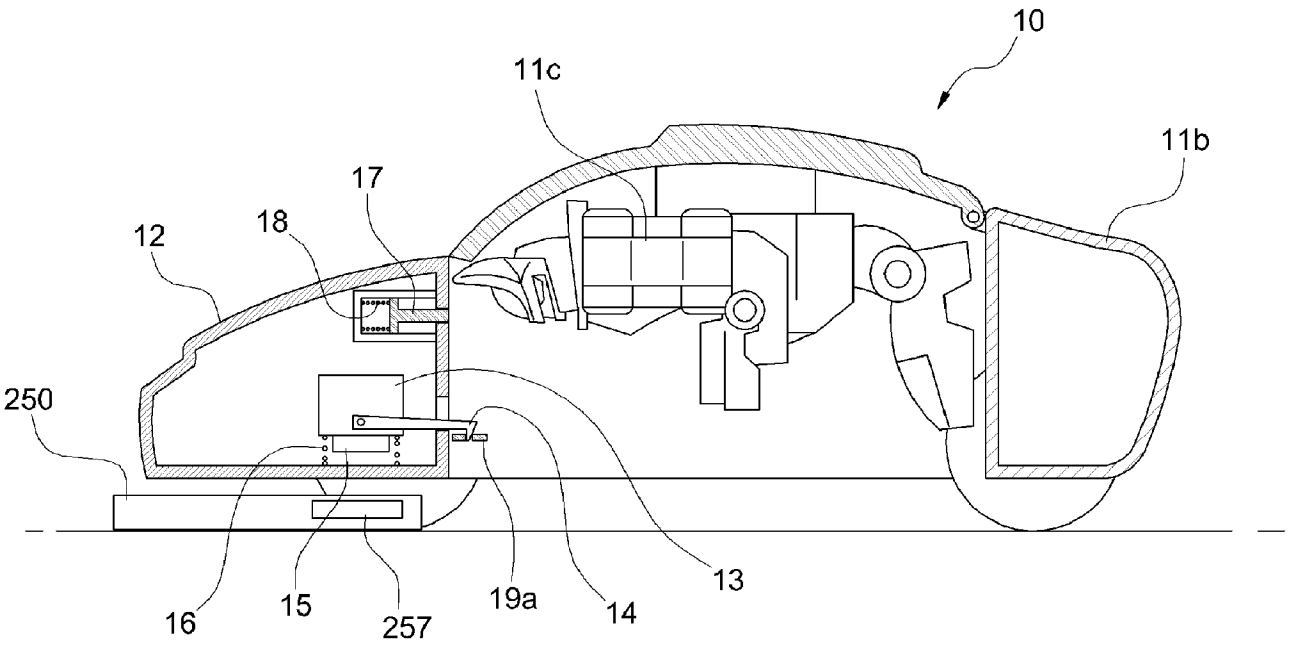
FIGS. 24 and 25 are sectional views showing transforming processes of the traveling object.

As shown in FIG. 24, the locking part of the traveling object 10 includes a locking part body 13 elastically supported against a spring 16 in the interior of the separable body 12, a latch 14 hinge-fastened to the locking part body 13 in such a manner as to be insertedly fixed to a first fastening groove 19*a* formed inside the body 11, and a magnet 15 disposed on the underside of the locking part body 13.

Further, a magnetic material 257 is disposed inside the transformation inducing item 250 to respond to the magnet 15.

If the traveling object 10 having the above configuration is launched from the transforming toy 200 and is thus driven to come into contact with the transformation inducing item 250, the magnet 15 of the locking part body 13 of the traveling object 10 moves downwardly by means of the magnetic material 257 of the transformation inducing item 250, and at this time, the latch 14 is separated from the first fastening groove 19*a*, so that the locking part of the traveling object 10 is released from the locking state thereof.

Figure 25:
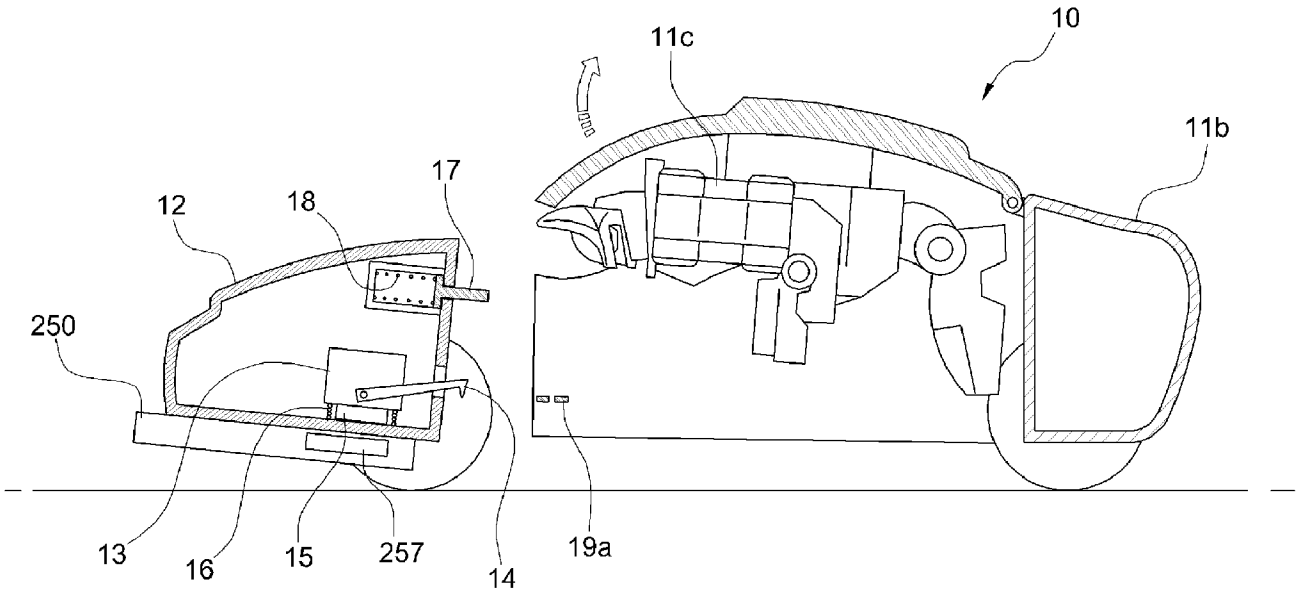

At this time, a pressurized latch 17 disposed in the separable body 12 in such a manner as to be pressurized against a spring 18 pushes the body 11 to allow the body 11 to be separated from the separable body 12, as shown in FIG. 25.

The body 11 from which the separable body 12 is separated rotates around the torque shaft of a rear side body 11*b* to allow a character 11*c* disposed therein to be exposed to the outside, and accordingly, the transformation as shown in FIG. 23 is completed.

Figure 26:
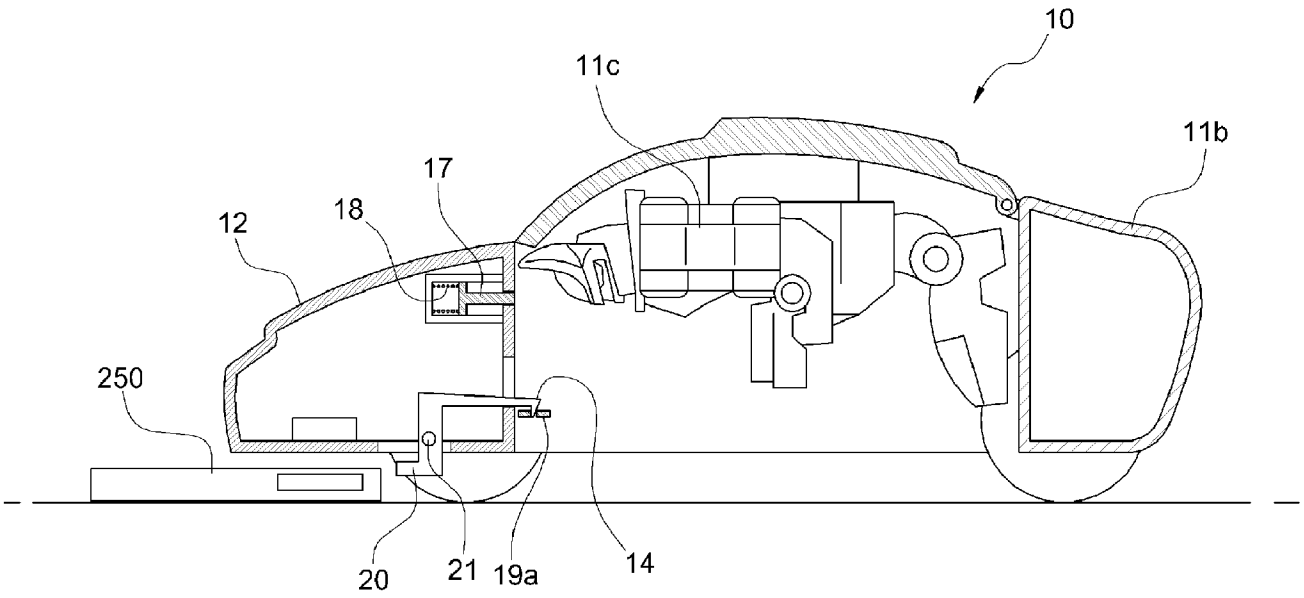
FIG. 26 is a sectional view showing another example of a traveling object locking part.

Another example of the locking part of the traveling object 10 is provided in FIG. 26, and in this case, a locking part body 20 is fastened to a lower portion of the separable body 12 by means of a shaft 21 and protrudes downwardly from the traveling object 10. Further, a latch 14 disposed on the opposite direction of the locking part body 20 to the shaft 21 is fastened to a first fastening groove 19*a* of the body 11.

If the traveling object 10 having the above configuration is launched from the transforming toy 200 and is thus driven to come into contact with the transformation inducing item 250, the locking part body 13 protruding downwardly from the traveling object 10 collides against the transformation inducing item 250 and rotates around the shaft 21, and at this time, the latch 14 is separated from the first fastening groove 19*a*, so that the locking part is released from the locking state thereof.

At this time, a pressurized latch 17 disposed in the separable body 12 in such a manner as to be pressurized against a spring 18 pushes the body 11 to allow the body 11 to be separated from the separable body 12, as shown in FIG. 25.

The body 11 from which the separable body 12 is separated rotates to allow the character 11*c* disposed therein to be exposed to the outside, and accordingly, the transformation as shown in FIG. 23 is completed.

The traveling object 10 may have various forms, without any specific limitation.

Figure 27:
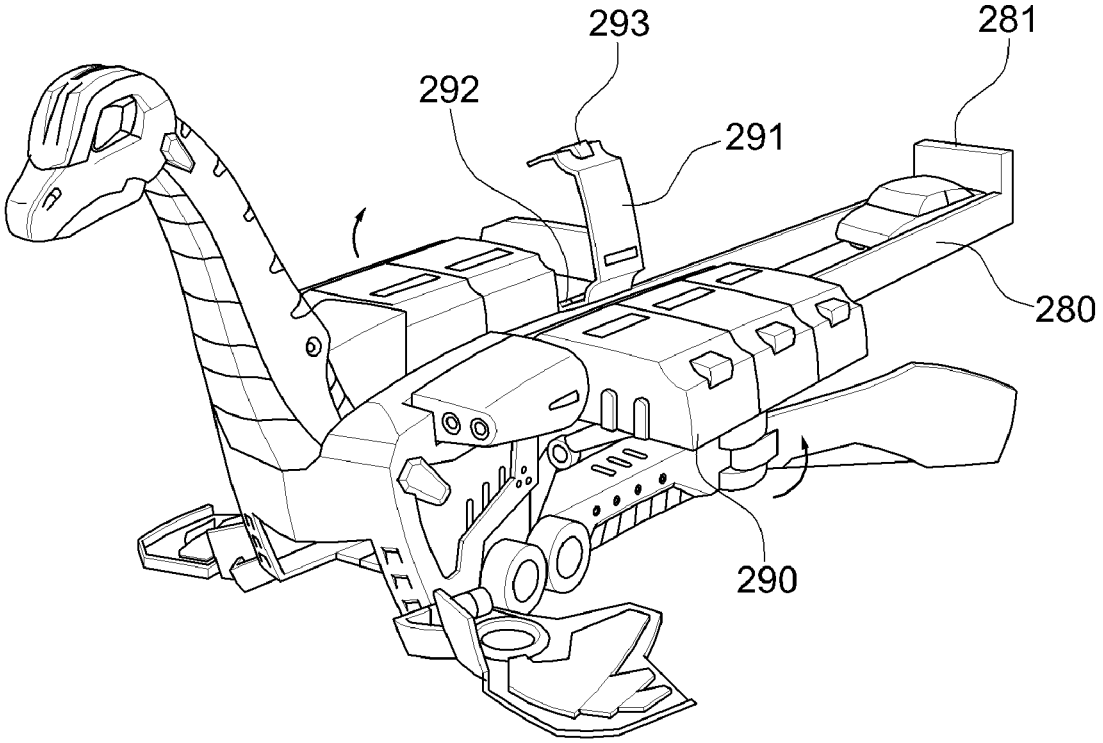
FIG. 27 is a perspective view showing a transforming toy according to a third embodiment of the present invention.

As mentioned above, the transforming toy 200 is configured to launch the traveling object 10 through the slope 202, but as shown in FIG. 27, a launch tray 280 slidingly movable is disposed on the transforming toy 200 to launch the traveling object 10.

As shown in FIG. 27, the launch tray 280 in which the traveling object 10 is accommodated is inserted into the transforming toy 200, and a back panel 281 of the launch tray 280 is pushed by the user to slidingly move the launch tray 280, so that the traveling object 10 can be launched.

At this time, the launch tray 280 is elastically supported against the main body 201 by means of a spring (not shown), and after the launch tray 280 is pulled and fixed to the rear side of the transforming toy 200 by means of a known locking part having various forms, the locking part is released by pressing a button (not shown), so that the launch tray 280 slidingly moves to launch the traveling object 10.

Further, as shown in FIG. 27, a plurality of loading boxes 290 are disposed on both sides of the transforming toy 200 to store the traveling object 10, the transformation inducing item 250, and the launching objects 260 launched from the transforming toy 200.

Each loading box 290 includes a door 291 fastened thereto by means of a torque shaft 292 and a button 293 as a locking part, and after the traveling object 10, the transformation inducing item 250, and the launching objects 260 are kept in the loading boxes 290, the doors 291 are closed. If the buttons 293 are pressed, the doors 291 are open to pick up the object or item required in a convenient manner.

The technical spirit of the present invention has been described through the disclosed embodiments of the present invention.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

Specific exemplary embodiments of the present invention have been described with reference to the attached drawings, and the whole scope of the invention is not limited to the exemplary embodiments of the present invention.

The invention claimed is:

1. A transforming toy comprising:

a main body comprising a traveling object inlet formed on one side thereof and a traveling object outlet formed on the other side thereof;

transforming bodies releasably fastened to the main body;

locking parts to restrain the transforming bodies;

a transformation operating part disposed on a path in an interior of the main body, the path connecting the traveling object inlet and the traveling object outlet, and the transformation operating part being configured to release the locking parts from restraining the transforming bodies; and a traveling object configured to be driven along the path, wherein the transforming bodies are released to transform a form of the transforming toy into another form, in response to the traveling object contacting the transformation operating part, and wherein the transformation operating part comprises:

a pair of rods rotatably disposed on both sides of the path and having push rods protruding from one side thereof, an impact bar having both side end portions fastened to the pair of rods, handles rotatably disposed on the main body and being configured to contact the push rods, the locking parts being configured to rotate cooperatively with the handles and having locking bars to restrain the transforming bodies, and the transformation operating part being further configured to release the transforming bodies through the displacement of the locking bars.

2. The transforming toy according to claim 1, wherein the path comprises an inclined slope, or an inclined slope is disposed on one side of the path, the inclined slope being configured to drive the traveling object along the slope by means of gravity.

3. The transforming toy according to claim 2, wherein the main body comprises a slope cover hinge-fastened thereto, and the slope cover contacts the slope so that the slope is extended, in response to the slope cover being open.

4. The transforming toy according to claim 1, further comprising a launch tray disposed on the traveling object inlet to apply a thrust force to drive the traveling object to the interior of the main body.

5. The transforming toy according to claim 4, wherein the launch tray is pushed by a user to apply the trust force to the traveling object seated thereon.

6. The transforming toy according to claim 1, further comprising:

first transforming bodies releasably fastened to the main body;

locking parts to restrain the first transforming bodies; and first transformation operating parts configured to release the locking parts from restraining the first transforming bodies, wherein the first transforming bodies are released to transform a form of the transforming toy through manipulation of the first transformation operating parts.

7. The transforming toy according to claim 6, wherein the first transforming bodies are doors disposed on the traveling object outlet of the main body, and the doors are released by the activation of the first transformation operating parts to open the traveling object outlet.

8. The transforming toy according to claim 6, further comprising a launching part disposed on the main body to launch launching objects through the displacement of the first transformation operating parts.

9. The transforming toy according to claim 8, wherein the launching part comprises:

launching holes formed on the main body;

firing pins disposed in the interiors of the launching holes in such a manner as to be elastically supported against springs; and a locking part for restraining the firing pins in such a manner as to release the locking states of the firing pins through the displacement of the transformation operating part or the transforming bodies.

10. The transforming toy according to claim 1, further comprising a transformation inducing item launching part disposed on the main body to launch a transformation inducing item through the displacement of the transformation operating part.

11. The transforming toy according to claim 10, wherein the transformation inducing item launching part comprises:

an item launching hole formed on the main body;

a firing pin disposed in the item launching hole to be elastically supported against a spring; and a locking part for restraining the firing pin in such a manner as to release the locking state of the firing pin through the displacement of the transformation operating part or the transforming bodies.

12. The transforming toy according to claim 10, wherein at the moment when the traveling object comes into contact with the launched transformation inducing item, a locking part of the traveling object is released to allow the traveling object to transform into another form.

13. The transforming toy according to claim 12, wherein the transformation inducing item has a magnetic material disposed in an interior thereof and the locking part of the traveling object has a magnet disposed on one side thereof, so that the magnet displaces the locking part of the traveling object through a magnetic force generated in response to the magnetic material of the transformation inducing item to release the locking state of the locking part of the traveling object.

14. The transforming toy according to claim 12, wherein the locking part of the traveling object is displaced through a physical contact with the transformation inducing item and is released from the locking state.

15. The transforming toy according to claim 8, wherein the main body has a plurality of loading boxes disposed thereon to store the launching objects, the traveling object, and a transformation inducing item.

* * * * *